US009498889B1

(12) United States Patent
Hawk et al.

(10) Patent No.: US 9,498,889 B1
(45) Date of Patent: Nov. 22, 2016

(54) DOUBLE ACTION, OUT THE FRONT, AUTOMATIC KNIFE

(71) Applicant: Hawk Designs Inc., Idaho City, ID (US)

(72) Inventors: Grant Woodrow Hawk, Idaho City, ID (US); Gavin Dan Hawk, Idaho City, ID (US)

(73) Assignee: HAWK DESIGNS INC, Idaho City, ID (US)

( * ) Notice: Subject to any disclaimer, the term of this patent is extended or adjusted under 35 U.S.C. 154(b) by 0 days.

(21) Appl. No.: 15/098,068

(22) Filed: Apr. 13, 2016

Related U.S. Application Data

(60) Provisional application No. 62/148,127, filed on Apr. 15, 2015.

(51) Int. Cl.
*B26B 1/08* (2006.01)
*B26B 1/10* (2006.01)

(52) U.S. Cl.
CPC .. *B26B 1/08* (2013.01); *B26B 1/10* (2013.01)

(58) Field of Classification Search
CPC ..... B26B 1/08; B26B 1/10
USPC ..... 30/151, 160, 162, 335
See application file for complete search history.

(56) References Cited

U.S. PATENT DOCUMENTS 845,792 A * 3/1907 Jenkins ..... B26B 1/08 30/162
8,671,578 B1 * 3/2014 Frazer ..... B26B 1/08 30/151
8,939,054 B2 * 1/2015 Hawk ..... B26B 1/04 30/151
9,375,854 B2 * 6/2016 Chu ..... B26B 1/08
2004/0261272 A1 * 12/2004 Moser ..... B26B 1/04 30/160
2006/0130340 A1 * 6/2006 Berns ..... B26B 5/003 30/162
2006/0207102 A1 * 9/2006 Bezold ..... B26B 1/08 30/162
2007/0107233 A1 * 5/2007 Polei ..... B26B 5/003 30/162
2007/0175045 A1 * 8/2007 McHenry ..... B26B 1/08 30/162
2014/0013605 A1 * 1/2014 Wu ..... B26B 5/003 30/162
2014/0101943 A1 * 4/2014 Chu ..... B26B 1/08 30/162
2014/0208596 A1 * 7/2014 Constantine ..... B26B 1/08 30/162

* cited by examiner

*Primary Examiner* — Sean Michalski
(74) *Attorney, Agent, or Firm* — Parsons Behle & Latimer

(57) ABSTRACT

A knife include a handle, button, blade with an integral tang, locking mechanism within the tang, and thrust mechanism. The blade moves between closed and open positions. The button axially slides along the handle. When the blade is in the closed position and locked, movement of the button towards the first handle end releases the locking mechanism and the thrust mechanism moves the blade to the open position. When the blade is in the open position and locked, movement of the button towards the second handle end releases the locking mechanism and the thrust mechanism moves the blade to the closed position. A knife includes a stop pin connected to a tang of a blade and a stop plate positioned within a knife handle. The stop plate has two angled surfaces. The stop pin mates with both angled surfaces and the blade is constrained from movement in two planes.

20 Claims, 17 Drawing Sheets

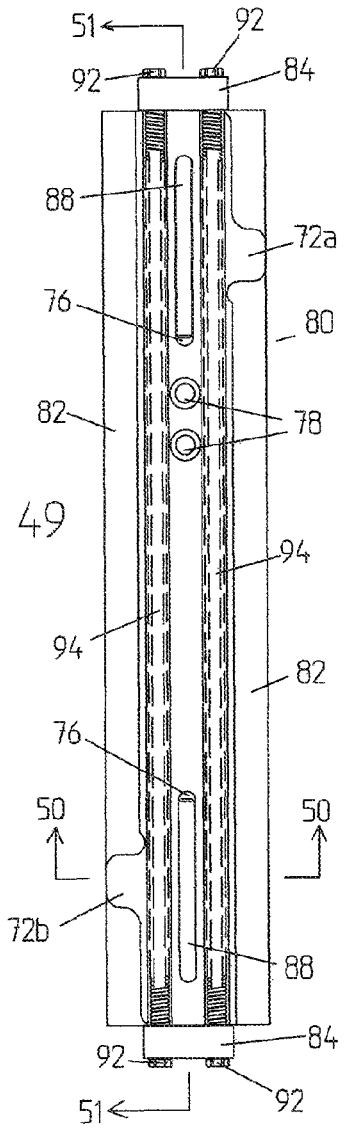
fig. 49
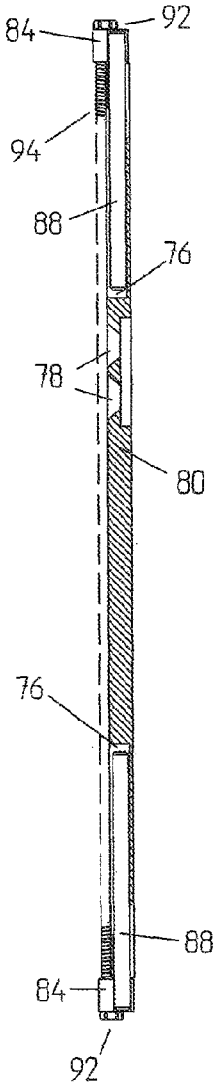
fig. 51
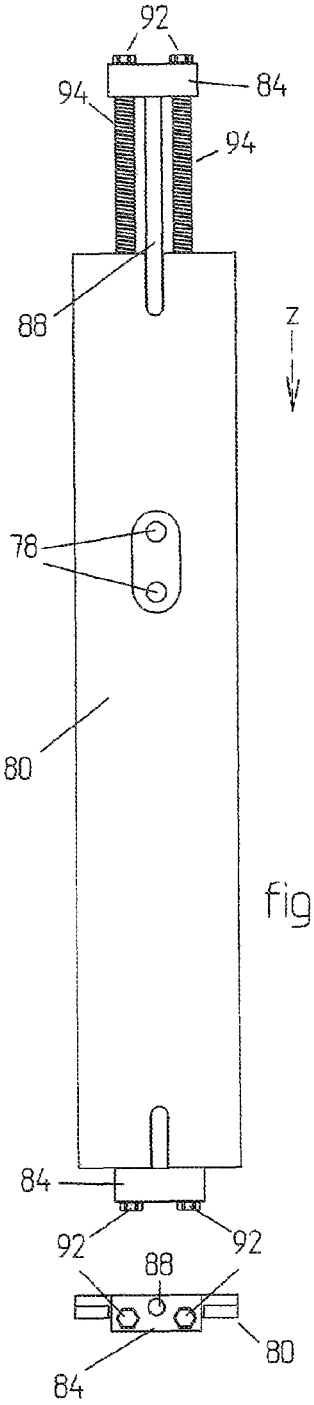
fig. 52a
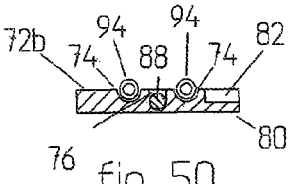
fig. 50
fig. 52b

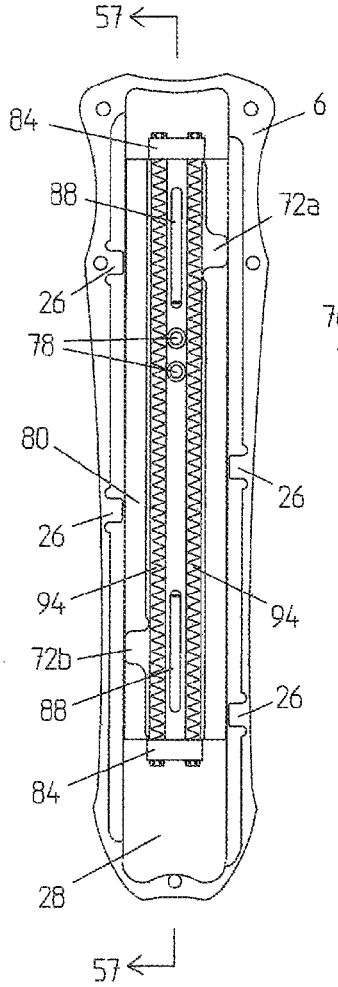
fig. 56
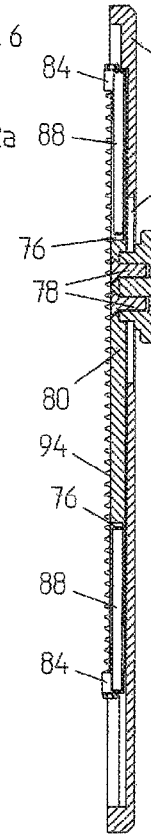
fig. 57
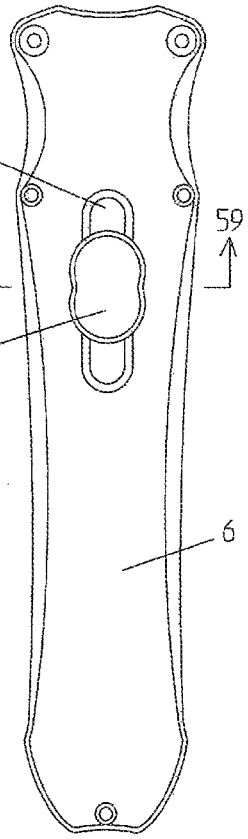
fig. 58
fig. 59
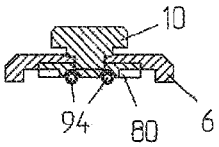

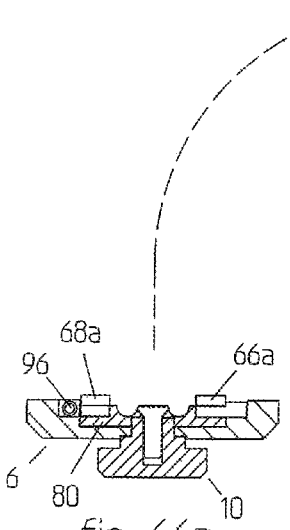
fig. 66a
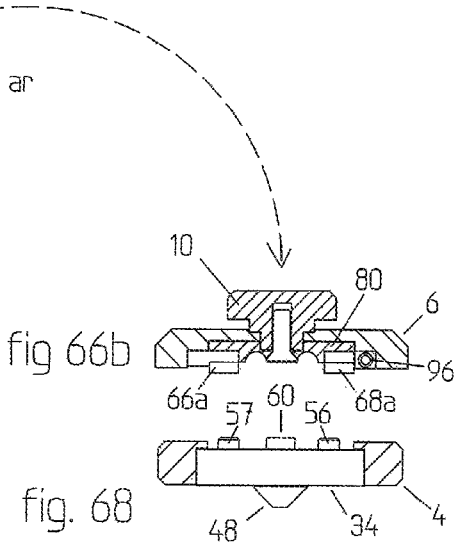
fig 66b
fig. 68
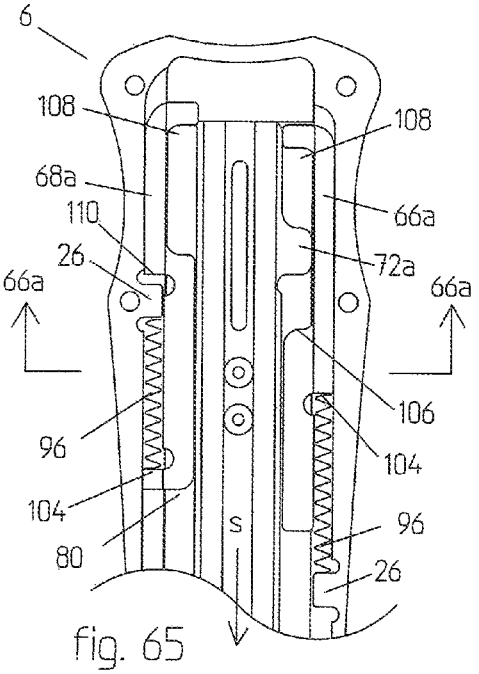
fig. 65
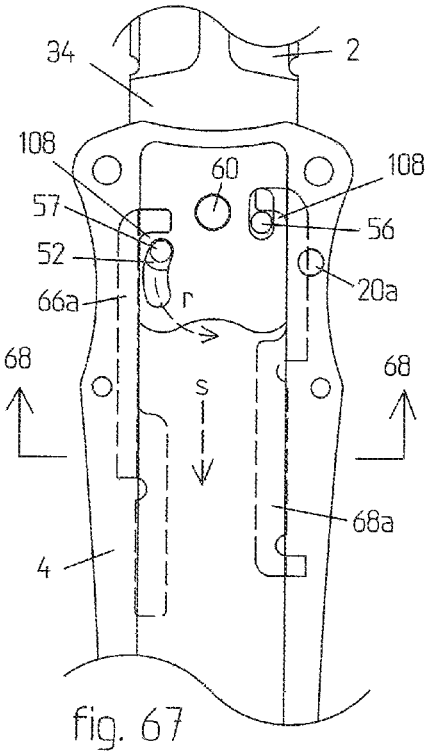
fig. 67

DOUBLE ACTION, OUT THE FRONT, AUTOMATIC KNIFE

CROSS-REFERENCE TO RELATED APPLICATION

This application, under 35 U.S.C. §119, claims the benefit of U.S. Provisional Patent Application Ser. No. 62/148,127 filed on Apr. 15, 2015 and entitled "Double Action, Out The Front, Automatic Knife," the contents of which are hereby incorporated by reference in its entirety.

FIELD OF THE DISCLOSURE

The embodiments described below are an improvement to the type of automatic opening knife that propels the blade, both in and out of the front of the handle, in a linear direction. Generally referred to as an out-the-front automatic or OTF.

BACKGROUND

Out-the-front automatic knives are of two principles types. Double action and single action. Both share the common features of a handle enclosure that contains a blade in a closed position. Automatic opening is achieved by activating a trigger mechanism, which releases the stored energy of a compressed spring. Thereby propelling the blade along a linear path, out the front of the handle, to an open and locked position.

Single action versions are limited to releasing the spring loaded blade by a trigger mechanism, thereby allowing the blade to fly forward to lock-up. Single action mechanisms rely upon a secondary operation to close and reload the blade against spring pressure, in preparation for the next firing.

Double action, out-the-front automatic knives perform both the automatic opening of the blade and the automatic closing of the blade with a single sliding button, activated by the user. The single sliding button being pushed in the direction desired for the blade to travel performs two primary functions; the first portion of the button travel results in the loading of a main spring in preparation for releasing the blade and the last portion of button travel serves to trigger the release.

Designers of out-the-front, double action, automatic knives face a wide array of difficult mechanical challenges. Among these challenges are:

The limitations of available space to house the mechanism required to perform the primary functions as set forth above. Users of out-the-front automatic knives place great importance on what is generally referred to as "blade to handle ratio". In other words, the smaller the handle in relation to the blade, the more desirable the design.

Because the blade must be essentially set free to fly to its destination, within the loosely defined limits of linear guides, to either a lock open or lock closed position, means that the locking method must account for restricting all six degrees of freedom inherent in a free floating blade. The lack of a solid lock up is a key defect, common to known out-the-front automatic (OTF) knives, which results in an undesirable amount of movement or play in the open "locked" blade. For at least this reason, knives of this category, although providing fascinating entertainment, are seldom taken seriously.

The force required to both propel the blade to a reliable lockup and to overcome the counter force of a spring loaded lock is limited to the force available from operator input.

Generally speaking, the closer a design approaches reliability, the more difficult it is to activate and thus may be perceived as less desirable.

The complex nature of the mechanical mission most often results in small, difficult to manufacture, precision parts, tending to push costs above the level of economic feasibility.

Other disadvantages exist. The many design issues have resulted in known OTF knives that may be of a clunky, disproportionate, unwieldy configuration, difficult to manipulate, under-powered to the point of unreliability, and terminating in a lock up that's both weak and wobbly. As a consequence, known OTF knives are generally considered to possess more theatrical value than practical value.

SUMMARY

The present disclosure is directed to an OTF knife that overcomes some of the problems and disadvantages discussed above.

One embodiment of a knife comprises a handle, button, blade, locking mechanism, and thrust mechanism. The handles has a first end and a second end. The button is connected to the handle and is configured to axially slide along a surface of the handle. The blade has an integral tang. The blade and tang are configured to move between a closed position wherein the blade and tang are positioned within the handle and an open position wherein the blade extends from the first end of the handle. The locking mechanism is positioned within the tang. When the blade is in the closed position and selectively locked, movement of the button towards the first end of the handle selectively releases the locking mechanism and the thrust mechanism moves the blade to the open position, the blade then being selectively locked in the open position by the locking mechanism. When the blade is in the open position and selectively locked by the locking mechanism, movement of the button towards the second end of the handle selectively releases the locking mechanism and the thrust mechanism moves the blade to the closed position, the blade then being selectively locked by the locking mechanism.

The locking mechanism may include a lock bar, rocker bar, and ball. The lock bar has a control pin and a cavity. The lock bar is configured to axially move within a cavity in the tang. The rocker bar has a control pin. A portion of the rocker bar is connected to the lock bar and the rocker bar is configured to pivot about an axis within a cavity in the tang. Rotational movement of the rocker bar axially moves the lock bar. When the locking mechanism is unlocked, the ball is positioned within the cavity of the lock bar. When the locking mechanism is locked, the ball is positioned between the lock bar and a dowel pin connected to the handle. The ball may not be positioned within the cavity of the lock bar when the locking mechanism is locked.

The knife may include an upper locking control hook, an upper unlocking control hook, a lower locking control hook, and a lower unlocking control hook. Movement of the button controls movement of the upper and lower unlocking control hooks. When the blade is in the locked open position, movement of the upper unlocking control hook towards the second end of the handle engages the control pin on the rocker bar to pivot the rocker bar to move the lock bar towards the first end of the handle that permits the ball to move into the cavity on the lock bar to selectively release the blade from the locked open position. When the blade is in the locked closed position, movement of the lower unlocking control hook towards the first end of the handle engages the control pin on the locking bar moving the locking bar towards the first end of the handle to permit the ball to move into the cavity on the lock bar to selectively release the blade from the locked closed position.

The thrust mechanism may include a shuttle plate connected to the button. The shuttle plate may include a first end, a second end, a lower profile, and an upper profile. The lower profile is configured to engage the lower unlocking control hook. When the blade is in the locked closed position, movement of the shuttle plate engages and moves the lower unlocking control hook. The upper profile is configured to engage the upper unlocking control hook. When the blade is in the locked open position, movement of the shuttle plate engages and moves the upper unlocking control hook.

The thrust mechanism may include an upper thrust block positioned at the first end of the shuttle plate, a lower thrust block positioned at the second end of the shuttle plate, and a plurality of springs positioned between the upper thrust block and the lower thrust block. Movement of the shuttle plate when the blade is in the locked open position or locked closed position increases the distance between the upper thrust block and the lower thrust block.

The tang of the blade may include a drive pin. When the blade is in the locked open position, the drive pin engages the upper thrust block. When the blade is in the locked closed position, the drive pin engages the lower thrust block. The knife may include a stop pin connected to the tang and a stop plate positioned within the handle. The stop plate has a first angled surface and a second angled surface. The stop pin is configured to mate with both the first angled surface and the second angled surface. When the stop pin mates with both the first and second angled surfaces the blade is constrained from movement in two planes.

One embodiment of a knife comprises a handle, a button on the surface of the handle, a thrust mechanism, a blade, a stop pin, and a stop plate. The button is movable between an open position and a closed position. The blade has an integral tang connected to the thrust mechanism and the button. When the button is moved from the closed position to the open position, the thrust mechanism moves the blade from being positioned entirely within the handle to a position extending from an end of the handle. When the button is moved from the open position to the closed position, the thrust mechanism moves the blade from a position extending from the end of the handle to being positioned within the handle. The stop pin is connected to the tang. The stop plate is positioned within the handle and has a first angled surface and a second angled surface. The stop pin is configured to mate with both the first angled surface and the second angled surface when the blade is in the position extending from the end of the handle. When the stop pin mates with both the first and second angled surfaces, the blade is constrained from movement in two planes.

The first angled surface may be substantially at 24 degrees with respect to a direction of travel of the stop pin and a horizontal axis of the blade. The second angled surface may be substantially at 45 degrees with respect to an axis of the stop pin and the horizontal axis of the blade.

One embodiment of a knife comprises a handle, blade, locking mechanism, and thrust mechanism, and switch. The blade has a tang and is configured to axially slide within the handle between an open position with at least a portion of the blade extending from the handle and a closed position with the blade within the handle. The thrust mechanism is configured to actuate the blade between the open position and the closed position. The locking mechanism is within the tang of the blade. The locking mechanism has a lock position and an unlock position. The lock position restricts movement of the blade with respect to the handle and the unlock position permits movement of the blade with respect to the handle. The same locking mechanism is configured to selectively lock the blade in the open position and closed position. The switch has a first position and a second position. Movement of the switch from the first position to the second position selectively actuates the locking mechanism from the lock position to the unlock position and the thrust mechanism moves the blade from the closed position to the open position. Movement of the switch from the second position to the first position selectively actuates the locking mechanism from the lock position to the unlock position and the thrust mechanism moves the blade from the open position to the closed position.

Movement of the blade between the open position and the closed position may actuate the locking mechanism from the unlock position to the lock position. The knife may include a stop pin connected to the tang and a stop plate positioned within the handle. The stop plate has a plurality of angled surfaces. The stop pin engages the plurality of angled surfaces when the blade is in the open position. The engagement of the stop pin with the plurality of angled surfaces restricts movement of the blade in at least two planes.

The locking mechanism may include a ball positioned in a ball pocket of the tang of the blade. The ball extends beyond a surface of the tang and contacts a portion of the handle to restrict movement of the blade with respect to the handle when the locking mechanism is in the lock position. The locking mechanism may include a lock bar configured to axially move along the tang. The lock bar has a recess configured to receive the ball when the locking mechanism is in the unlock position and a ramp adjacent the recess. The ramp is shaped to guide the ball from the recess to the ball pocket with axial movement of the tang. The locking mechanism may include a rocker bar pivotally connected to the tang of the blade. The rocker bar is configured to engage the lock bar and convert rotational motion of the rocker bar into axial motion of the lock bar.

The knife may include an upper locking control hook, an upper unlocking control hook, a lower locking control hook, and a lower unlocking control hook. The switch may control movement of the upper unlocking control hook and the lower unlocking control hook. The upper locking control hook is positioned to engage a portion of the lock bar when the blade slides from the closed position to the open position. The lower locking control hook is positioned to engage a portion of the rocker bar when the blade slides from the open position to the closed position. When the blade is in the open position, movement of the upper unlocking control hook engages a portion of the rocker bar. When the blade is in the closed position, movement of the lower unlocking control hook engages a portion of the lock bar.

The thrust mechanism may include a shuttle plate connected to the switch. The shuttle plate may include a first end, a second end, a lower profile configured to engage the lower unlocking control hook, and an upper profile configured to engage the upper unlocking control hook. The thrust mechanism may include an upper thrust block positioned at the first end of the shuttle plate, a lower thrust block positioned at the second end of the shuttle plate, and at least one spring positioned between the upper thrust block and the lower thrust block. Movement of the shuttle plate when the blade is in the open or closed position increases the distance between the upper thrust block and the lower thrust block.

The tang of the blade may include a drive pin configured to selectively engage the upper thrust block and lower thrust block.

BRIEF DESCRIPTION OF THE DRAWINGS

The disclosure may be better understood by reference to the following detailed description when taken in conjunction with the following drawings.

FIG. 41 is an edge view of the shuttle plate.

FIGS. 42, 43, and 44 are cross sectional views of the shuttle plate of FIG. 40.

FIG. 49 is a bottom plan view of the shuttle plate assembly with thrust blocks and main springs installed.

FIG. 50 is a short axis cross sectional view of FIG. 49.

FIG. 51 is a long axis cross section of FIG. 49.

FIG. 52*a* is a top plan view of a shuttle plate assembly.

FIG. 52*b* is an end view of a shuttle plate assembly.

FIG. 56 is a bottom plan view of top handle cover containing shuttle plate assembly.

FIG. 57 is a cross sectional view of FIG. 56.

FIG. 58 is top plan view of top handle cover showing sliding button installed.

FIG. 59 is a cross sectional view of FIG. 58.

FIG. 65 is a partial bottom plan view of top cover with shuttle plate, control hooks, and control hook springs installed.

FIG. 66*a* is a cross sectional view as indicated in FIG. 65.

FIG. 66*b* is the same cross section as FIG. 66*a*, but reoriented to indicate alignment of assembly.

FIG. 67 is a partial top plan view of handle center section with blade installed.

FIG. 68 is a cross sectional view as indicated in FIG. 67.

Figures 1, 2, 3:
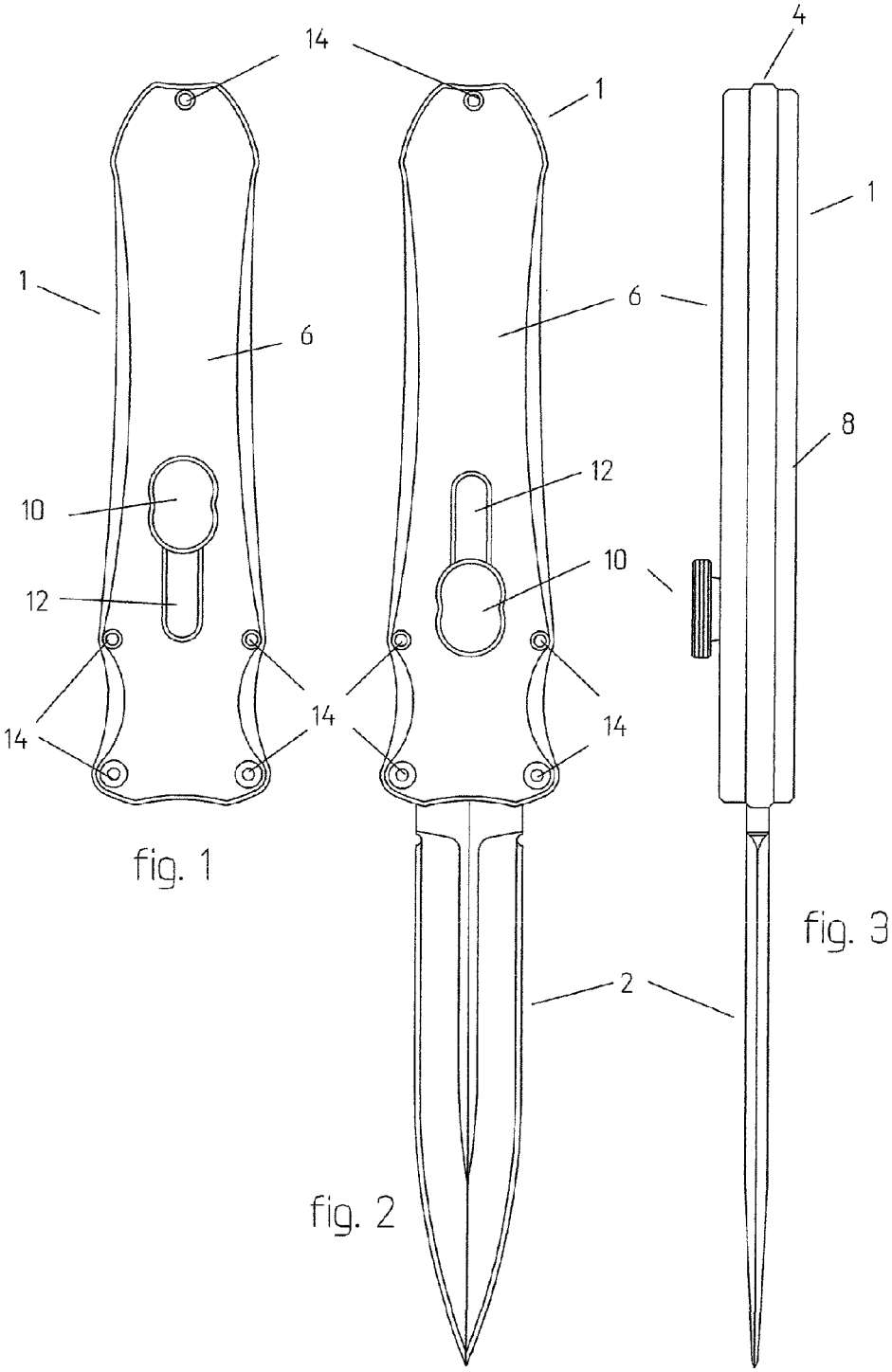
FIG. 1 is a top plan view of an OTF knife, according to one embodiment of the present disclosure, showing a blade in the closed position.
FIG. 2 is a top plan view of the knife showing the blade in an open position.
FIG. 3 is a side view of the knife showing the blade in an open position and the orientation of top and bottom as used hereinafter.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents, and all alternatives falling within the scope of the disclosure as defined by the appended claims.

DETAILED DESCRIPTION

One embodiment of the current disclosure is illustrated in FIGS. 1 through 3. FIG. 1 is a top plan view showing an OTF knife 1 with a blade 2 in a retracted, closed position. In FIG. 1, a sliding button 10 is shown in a rearmost retracted position, relative to a sliding button slot 12. A perimeter configuration is shown of a handle frame top cover 6 which encompasses the internal mechanism and provide sufficient area to locate fasteners 14. Fasteners secure the top handle cover 6, a bottom handle cover 8, and a handle frame center section 4. The shape and configuration of the blade 2, sliding button 10, sliding button slot 12, handle frame 4, and top cover 6 is for illustrative purposes only and may be varied within the scope of this disclosure as would be appreciated by one of ordinary skill in the art having the benefit of this disclosure.

FIG. 2 shows the OTF knife 1 with the blade 2 in the forward extended and locked position. The sliding button 10 is shown in the forward position relative to sliding button slot 12. FIG. 3 shows a side view of the OTF knife 1, illustrating the relative position of top handle cover 6, bottom handle cover 8, and handle frame center section 4. In the following drawings, all references to point of view will coincide with FIGS. 1, 2, and 3, in regards to the top, side, and bottom views. Forward will indicate the direction that blade 2 emerges from handle assembly 4, 6, and 8, while rearward will indicate the direction that blade 2 travels in retracting back into handle assembly 4, 6, and 8.

FIGS. 4 through 8 illustrate the details of handle center section 4 indicating the position of blade guide rails 22 which supports and guides blade 2 (not shown in FIGS. 4-8) as blade 2 is propelled forward and rearward. Two dowel pins 20*a* and 20*b* are pressed into machined pockets cut into center section 4 at the locations indicated. The dowel pins 20*a* and 20*b* serve as stationary stops, against which a moving locking ball 36, to be described later, comes into engagement, thereby locking blade 2, in both the forward extended position and the rearward retracted position.

Figure 5:
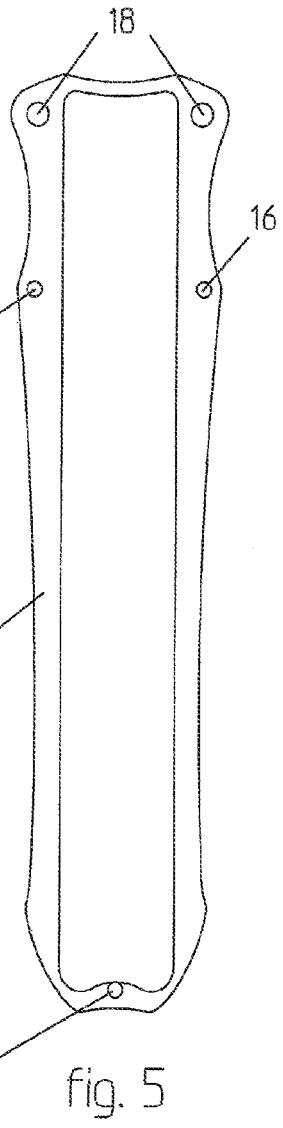
FIG. 5 shows a top plan view of the same center section as shown in FIG. 4
Figure 11:
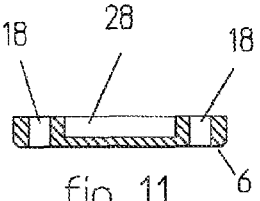
FIGS. 11, 12, 13, and 14 are cross sectional views of the corresponding cross sections indicated in FIG. 9.
Figure 12:
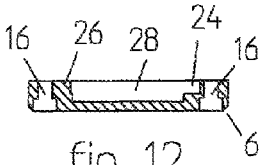
Figure 13:
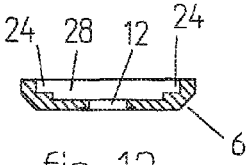
Figure 14:
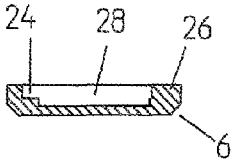

FIG. 5 shows a top plan view of handle center section 4. Fastener holes 16 are configured to receive fasteners 14 (shown in FIG. 2) while a smooth bore to accept threaded inserts are shown at 18. It is appreciated that other types of fasteners may be used, such as, but not limited to, rivets, screws, welds, and pins.

Figure 6:
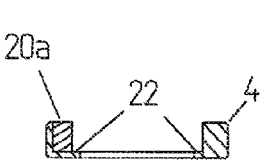
FIGS. 6, 7, and 8 are cross sectional views of the corresponding cross sections as indicated in FIG. 4
Figure 7:
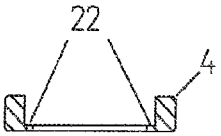
Figure 8:
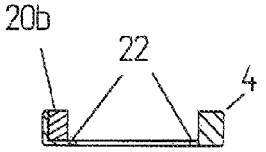
Figure 4:
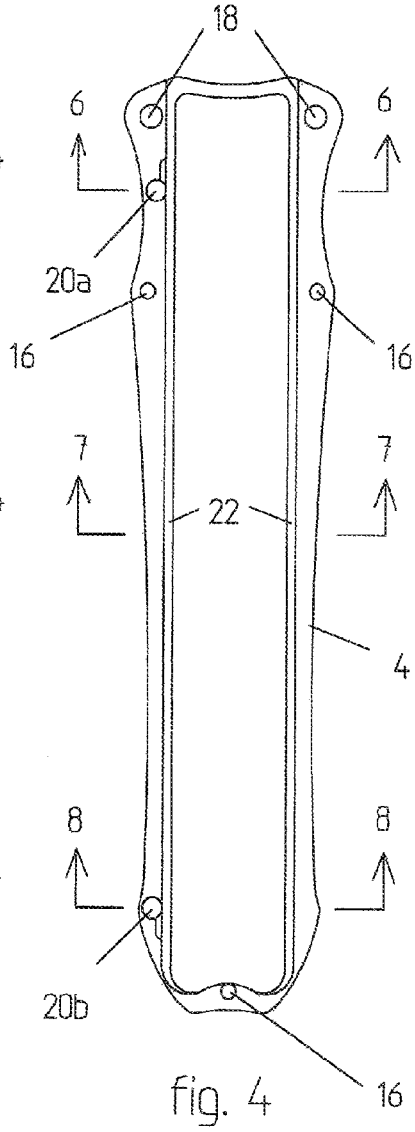
FIG. 4 shows a bottom plan view of the center section of the knife of FIG. 3

FIGS. 6 through 8 are cross sectional views of handle center section 4 as indicted in FIG. 4 showing the relative positions of dowel pins 20*a* and 20*b* and blade guide rails 22.

Figure 9:
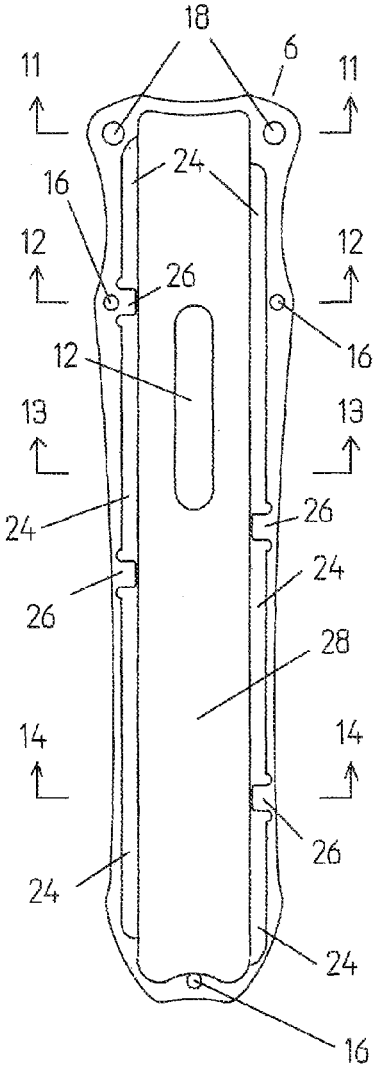
FIG. 9 is a bottom view of the top handle cover of FIGS. 1 through 3

FIGS. 9 through 14 illustrate the details of top handle frame cover 6. FIG. 9 is a bottom plan view of top handle frame cover 6 indicating the relative locations of internal features. Control hook pockets 24 delineate the boundaries of a cavity, providing for the control of a linear, forward and rearward motion of control hooks 66*a*, 66*b*, 68*a*, and 68*b* to be shown in subsequent drawings. Control hook spring stops 26 are bosses, left standing in the control hook pockets 24, to serve as spring abutments for control hook springs 96, to be shown later. The shuttle plate pocket 28 also captures and constrains to a linear motion, the shuttle plate 80, also shown later.

Figure 10:
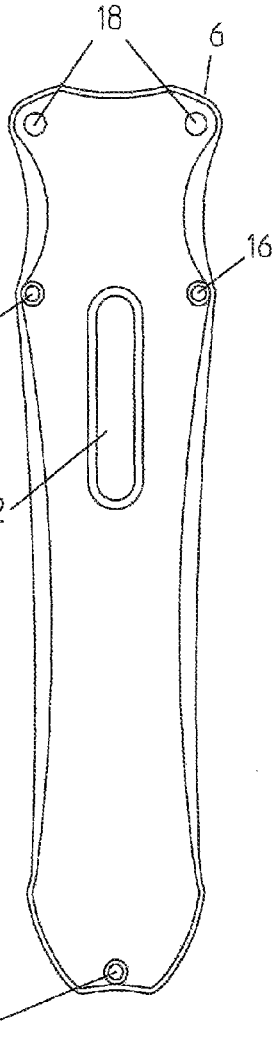
FIG. 10 is a top view of the top handle cover.

FIG. 10 is a top plan view of top handle cover 6 showing button slot 12 and fastener locations 16 and smooth bores to accept threaded inserts 18. FIGS. 11 through 14 are cross sectional views as indicated in FIG. 9 further illustrating internal features of top handle cover 6.

Figure 17:
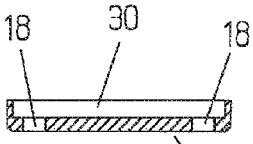
FIGS. 17 and 18 are cross sectional views of the corresponding cross sections as indicated in FIG. 15.
Figure 18:
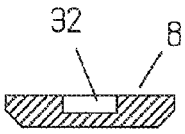
Figure 15:
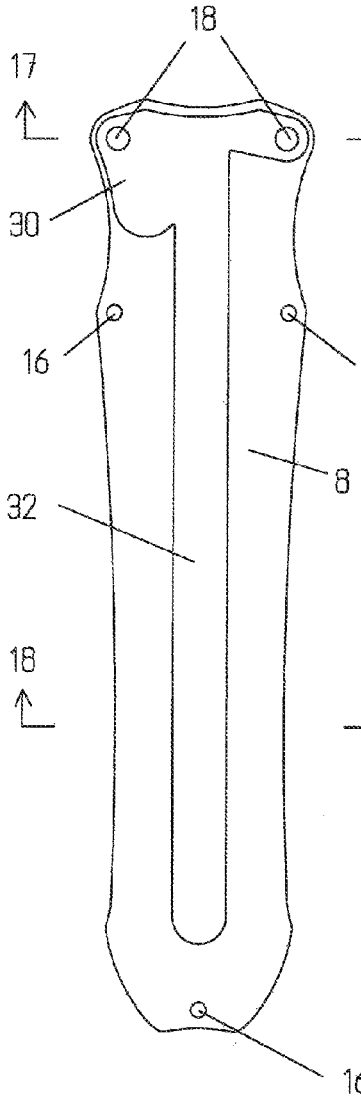
FIG. 15 shows a top plan view of the bottom handle cover of FIG. 3
Figure 16:
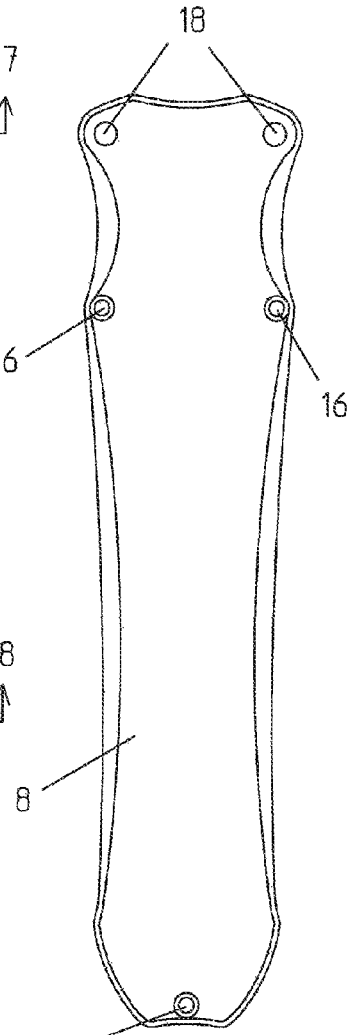
FIG. 16 shows a bottom view of the bottom handle cover.
Figure 19:
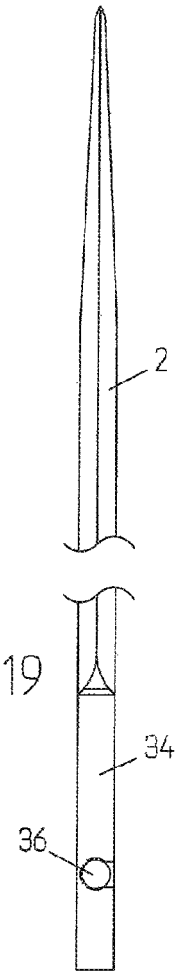
FIG. 19 is a side view of the blade and tang.

FIGS. 15 through 18 illustrate the details of bottom handle frame cover 8. FIG. 15 is a top view of the bottom handle frame cover 8, indicating the relative locations of internal features. The stop plate pocket 30, shown in FIGS. 15 and 17, provides a positive location for stop plate 70, shown later. The stop pin clearance groove 32, shown in FIGS. 15 and 18, allows for clearance of stop pin 48 (not shown in FIGS. 15-18), protruding from blade tang 34, as blade 2 and integral blade tang 34 are propelled forward and back, upon opening and closing of OTF knife 1. Blade 2 and blade tang 34, along with stop pin 48 are shown later. FIG. 16 is a bottom plan view of bottom handle frame cover 8.

Figure 20:
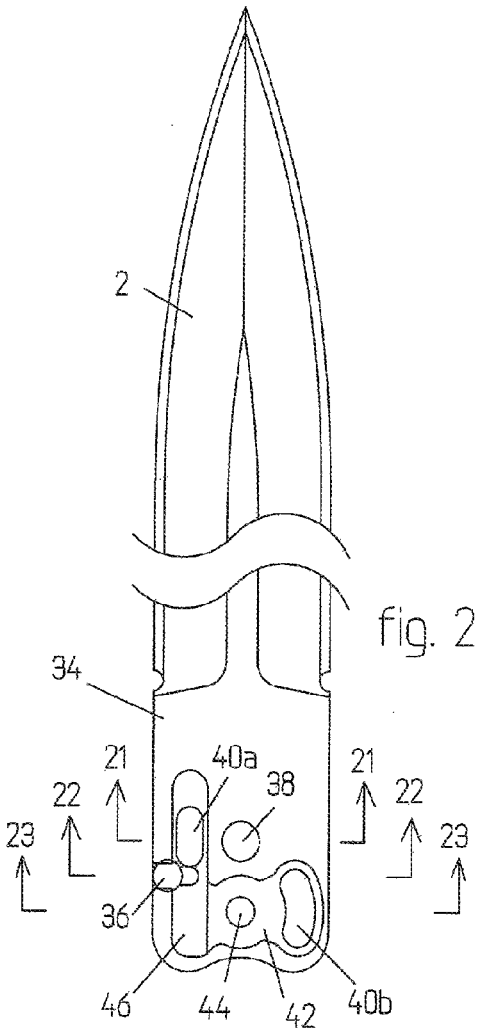
FIG. 20 is a bottom plan view of the blade and tang.
Figure 21:
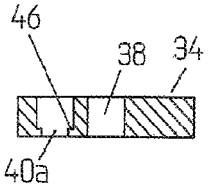
FIGS. 21, 22, and 23 are cross sectional views of the corresponding cross sections indicated in FIG. 20.
Figure 22:
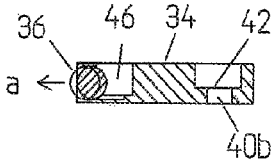
Figure 23:
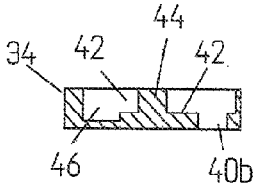

FIGS. 19 through 23 illustrates various details of the blade 2 and integral tang 34 in regards to the machining of pockets, holes and slots to accommodate a locking mechanism. FIG. 20 is a top plan view of blade 2 and blade tang 34, including a locking ball 36. Locking ball 36 is used to lock the blade 2 and integral blade tang 34 in both the forward locked open position and the rearward locked closed position. The locking ball 36 being subject to manipulation by a locking mechanism, to be disclosed in subsequent drawings, is caused to travel in a limited linear path between the unlocked position shown in FIG. 20 to an alternate locked position as shown in the cross sectional view of FIG. 22 in accordance with arrow (a). Stop pin bore 38 positions and secures stop pin 48 (not shown in FIGS. 19-23), which limits the travel of blade 2 and integral blade tang 34, at a predetermined point upon reaching the open position of blade 2. Control pin slot 40*a*, allows for forward and rearward travel of control pin 56 (not shown in FIGS. 19-23). Control pin slot 40*b*, allows for the rotational travel of control pin 57 (not shown in FIGS. 19-23), as described below. Rocker pocket 42 is a pocket, machined into the blade tang 34, configured to position and allow limited rotational movement of rocker bar 52 (not shown in FIGS. 19-23). Rocker bar pivot point boss 44 is left standing upon the machining of rocker bar pocket 42 to provide a fixed axis of rotation for rocker bar 52 (not shown in FIGS. 19-23). Lock bar pocket 46, is a pocket machined into blade tang 34, configured to position and allow limited forward and rearward travel of lock bar 50 (not shown in FIGS. 19-23).

FIGS. 24 through 28 illustrate the configuration and arrangement of a locking mechanism. FIG. 26*a* shows a side view of a lock bar 50. FIG. 26*b* shows an end view of the lock bar 50. FIG. 26*c* shows a bottom view of lock bar 50. The lock bar 50 may include a pressed in control pin 56 that protrudes a predetermined distance from the top surface of the lock bar 50 and remains flush to the bottom surface of lock bar 50. Alternatively, control pin 56 may be integral to the lock bar 50. Also shown is a lock bar ramp 54 positioned on the side of lock bar 50, at the location indicated in FIG. 26*c*. Lock bar ramp 54 is established at a slight angle (approximately 7°) with respect to the controlled linear path of lock bar 50. As lock bar 50 moves from the forward position to the rearmost position within lock bar pocket 46, lock bar ramp 54 engages locking ball 36, driving lock ball 36 in the direction of arrow (a) of FIG. 28, thereby achieving a locked condition by virtue of the engagement of lock ball 36 with dowel pin 20*a* (not shown). As lock bar 50 moves from the rearward position to the forward position within lock bar pocket 46, lock bar ramp 54 relieves the wedging force and allows locking ball 36 to occupy the space provided by lock ball relief cavity 55, thereby achieving a de-locked condition. A lock bar pocket 62 provides for a positive engagement with a rocker bar tongue 64 of a rocker bar 52, shown in FIGS. 27*a-c*.

Figure 27A:
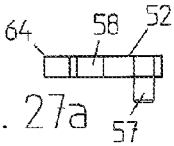
FIG. 27*a* is a side view of a rocker bar.
Figure 27B:
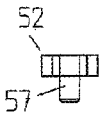
FIG. 27*b* is an end view of a rocker bar.
Figure 27C:
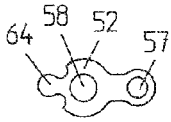
FIG. 27*c* is a bottom view of a rocker bar.

FIGS. 27*a-c* shows a rocker bar 52 in three views; a side view, an end view and a bottom plan view. The rocker bar 52 may include a pressed in control pin 57 that protrudes a predetermined distance from the top surface of the rocker bar 52 while remaining flush with the bottom surface of rocker bar 52. Alternatively, control pin 57 may be integral to the rocker bar 52. A rocker tongue 64 provides a means for a positive engagement with the aforementioned lock bar pocket 62 of lock bar 50, shown in FIGS. 26*a-c*. The interface between the lock bar pocket 62 of lock bar 50 and rocker tongue 64 of rocker bar 52 is closely controlled along the long axis of lock bar 50, but provided with sufficient clearance along the short axis of lock bar 50 to allow for the arc of rotation of rocker bar tongue 64 of rocker bar 52. Additionally a rocker bar pivot point bore 58, which may be established by a hole bored through rocker bar 52, provides a fixed center of rotation when engaged with a rocker pivot point boss 44, shown in FIGS. 24, 25, and 28.

Figure 25:
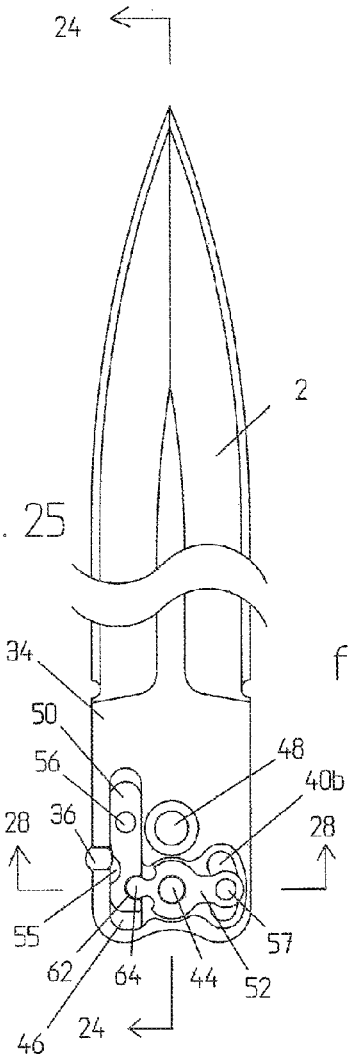
FIG. 25 is a bottom plan view of the blade and tang shown in FIG. 24 showing an assembled lock mechanism.
Figure 24:
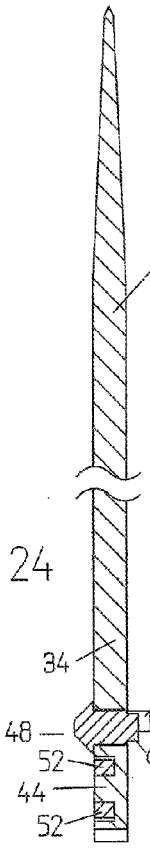
FIG. 24 is a cross sectional side view of the long axis of a blade and tang.
Figure 26C:
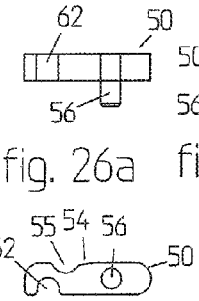
FIG. 26*c* is a bottom view of a lock bar.
Figures 26A, 26B:
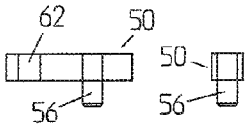
FIG. 26*a* is a side view of a lock bar.
FIG. 26*b* is an end view of a lock bar.
Figure 28:
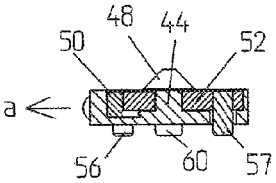
FIG. 28 is a cross section of the assembled lock mechanism as indicated in FIG. 25.

FIG. 25 is a bottom plan view of blade 2 and integral tang 34, with the locking mechanism in place. Rocker bar pivot point bore 58 of rocker bar 52 is engaged with rocker pivot point boss 44. Lock ball 36 is shown partly protruding from a pocket machined in integral tang 34. The pocket may be machined by the use of a ball end cutter that starts a cut from a point within the lock bar pocket 46 and stops short of breaking through the side surface of blade tang 34, thereby establishing a shoulder for the purpose of containing locking ball 36. The lock bar 50 is constrained within integral tang 34 by an elongated machined lock bar pocket 46 limiting travel of the lock bar 50 to a forward and rearward direction. Rocker tongue 64 of rocker bar 52 engages the rocker bar pocket 62 of lock bar 50. Lock bar 50 and rocking bar 52 are shown in FIG. 25 in their mid-travel position. When lock bar 50 is moved to its full forward position the lock ball 36 is free to occupy a ball relief cavity 55 of lock bar 50. When the lock bar 50 is moved to its full rearward position, lock bar ramp 54 forces lock ball 36 to protrude at least partially from integral tang 34, resulting in a locked engagement with a dowel pin 20*a* or 20*b* shown in FIGS. 4, 6, and 8. Stop pin 48 is shown in FIGS. 24, 25 and 28. A drive pin extension 60 of stop pin 48 is shown in FIGS. 24 and 28. The drive pin extension 60 provides a point of engagement for a thrust block 84 (not shown in FIGS. 25-28). Thrust block 84 is a spring powered component that drives blade 2 and integral tang 34 toward open and closed. FIG. 24 shows stop pin 48 positioned in stop pin bore 38 (best shown in FIG. 20) with the protrusion of drive pin extension 60 positioned above the top surface of blade tang 34 to allow for contact with thrust block 84.

Control pin 57 is shown in FIGS. 25, 27*a-c*, and 28 as installed in rocker bar 52. FIG. 25. shows how control pin slot 40*b* allows for the limited rotation of rocker bar 52, along with its installed control pin 57. Rocker bar 52 is rotatably positioned on rocker pivot point boss 44 through rocker bar pivot point bore 58. As rocker bar 52 rotates about the axis of rocker pivot point boss 44, control pin 57 is made to move forward or rearward within the curved control pin slot 40*b*.

Figure 29:
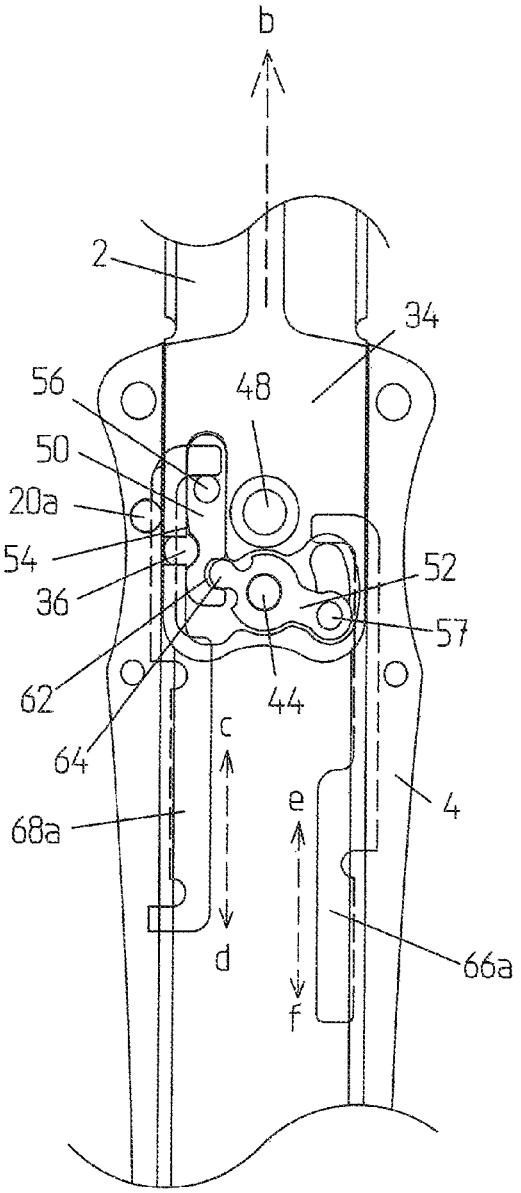
FIG. 29 is a bottom plan view of the blade and tang with lock mechanism installed, as the blade and tang approach the lock open position.
Figure 30:
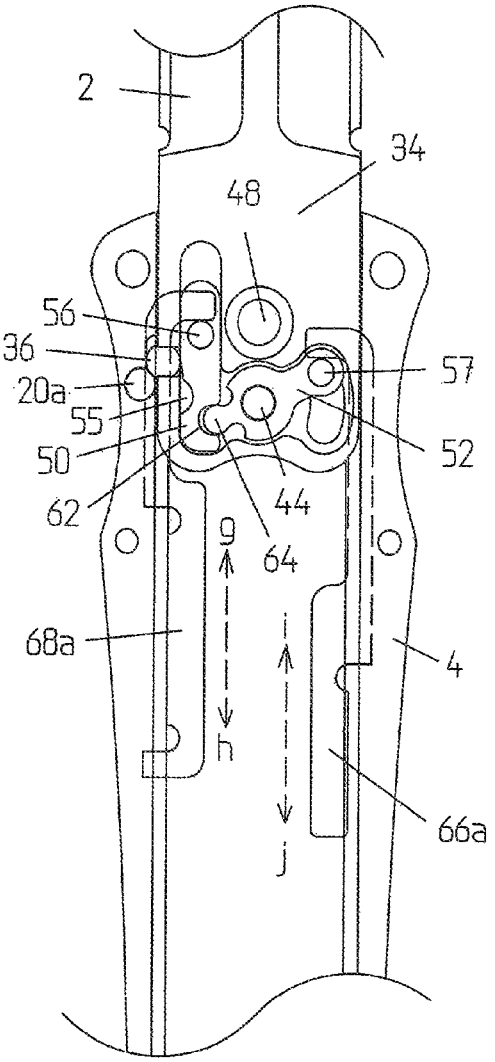
FIG. 30 is a bottom plan view of the blade and tang in the locked open position.

FIGS. 29 and 30 show a partial bottom plan view of handle center section 4, containing integral tang 34, with the locking mechanism and control hooks 66*a* and 68*a* in place. FIG. 29 illustrates a point in time during the travel of blade 2, and its combined assembly, slightly before forward open lock up.

FIG. 30 illustrates the same blade 2 and its assembly as in FIG. 29, in its final position of forward open lock up. It should be noted, that portions of the control hooks 68*a* and 66*a* are shown as dotted lines, to indicate their true location, as being on the opposite side of handle center section 4 and integral tang 34.

Because blade 2, and its included locking mechanism, is propelled to both the open and closed positions, by a spring powered propulsion system, discussed herein, it may be beneficial to minimize drag or friction as the blade 2 and its entire assembly fly freely. In the present disclosure, however, it might be beneficial that the spring loading of the ball does not take place until the last possible moment of its travel towards lock up. This result may be achieved by the method illustrated in FIGS. 29 and 30, and explained below.

In FIG. 29 it can be seen that at this point in time, when blade 2 and its assembly are traveling forward in the direction of arrow (b), the control pin 56 of lock bar 50 will come into contact with control hook 68*a*. Because control hook 68*a* is spring loaded (best shown in FIGS. 62 and 63) in the direction of arrow (d), lock bar 50 will also be driven in the direction of arrow (d) as blade 2 is driven toward lock open. All of which in turn will force lock ball 36 into engagement with dowel pin 20*a*, by virtue of lock bar ramp 54, resulting in the locked open configuration as shown in FIG. 30. As this transition to locked open takes place, rocker bar 52 and its installed control pin 57, is caused to rotate counter clockwise by virtue of the engagement between rocker bar tongue 64 of rocker bar 52 and lock bar pocket 62 of lock bar 50. Rocker bar 52 rotates about a fixed center of rotation as established by rocker bar boss 44. The exact end point of travel of blade 2 and integral tang 34 is determined by contact between stop pin 48 and stop plate 70 (not shown in FIGS. 29 and 30).

It should be noted that in the lock open position as illustrated in FIG. 30, blade 2 may be unlocked by the sliding of control hook 66*a* in the direction of arrow (j) to engage control pin 57, which will then rotate rocker bar 52 in a clockwise direction. As a result of the rotation of rocker bar 52, locking bar 50 will be forced in the direction of arrow (g) via the engagement between lock bar pocket 62 and rocker bar tongue 64, thereby allowing lock ball 36 to recede back into lock ball relief cavity 55, which in turn unlocks blade 2 allowing it to respond to new input.

Figure 31:
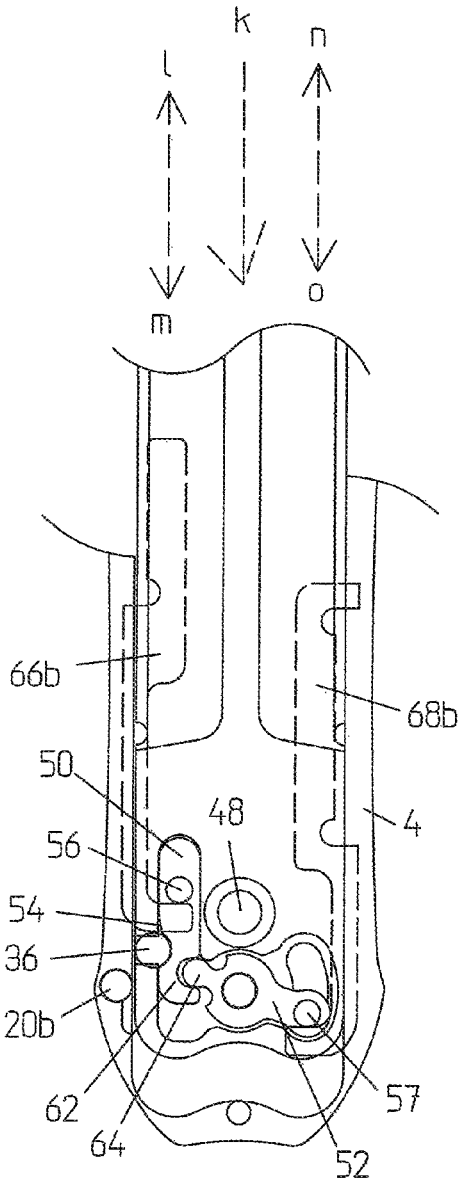
FIG. 31 is a bottom plan view of the blade and tang with lock mechanism installed, as it approaches the locked closed position.
Figure 32:
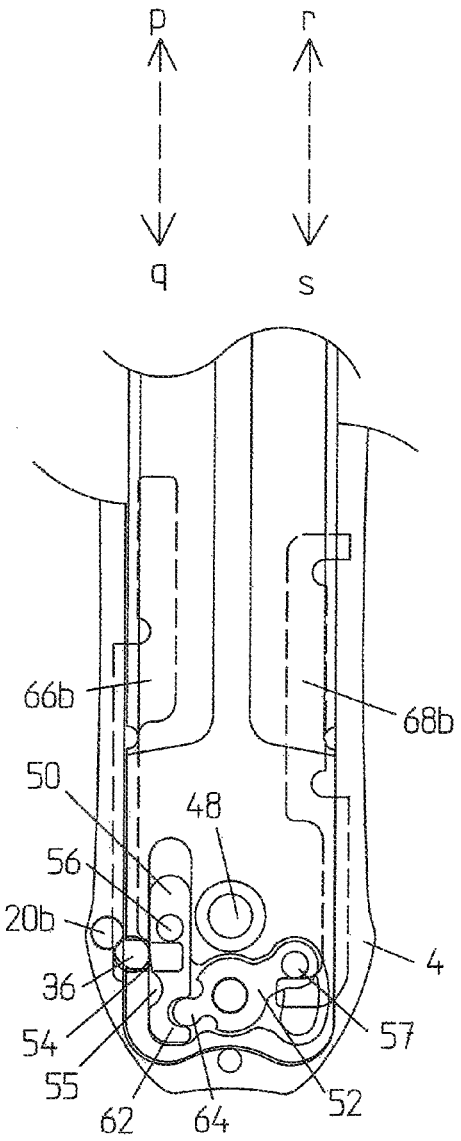
FIG. 32 is a bottom plan view of the blade and tang in the locked closed position.

FIGS. 31 and 32 illustrate the closed rearward locking sequence of blade 2 and its lock assembly. FIG. 31 shows blade 2 in its final approach toward the lock closed position as shown in FIG. 32. As shown in FIG. 31, as blade 2 nears the lock closed position, control pin 57 contacts control hook 68*b* which is spring loaded in the direction of arrow (n) thereby rotating rocking bar 52 counter clockwise, which moves lock bar 50 in the direction of arrow (m) via the engagement between lock bar pocket 62 and rocker bar tongue 64, forcing lock ball 36 into engagement with dowel pin 20*b* by virtue of lock bar ramp 54, resulting in the lock closed position shown in FIG. 32. In the lock closed position shown in FIG. 32, blade 2 may be unlocked by the sliding of control hook 66*b* in the direction of arrow (p) thereby allowing lock ball 36 to recede back into lock ball relief cavity 55 (best seen in FIG. 26*c*), which in turn unlocks blade 2 allowing it to respond to new input. Stop pin 48 is not utilized in the closed position shown in FIG. 32. Travel of blade 2 and blade tang 34 is stopped by its contact within the limits of handle center section 4, as defined by blade guide rail and pocket 22 (not shown in FIGS. 31 and 32). Further, travel of blade 2 and blade tang 34 is limited by the engagement of control pin 57 of rocker bar 52 with spring loaded locking control hook 68*b*, as described below.

As discussed above, known OTF knives are unable to lock up the open blade and adequately restrict all six degrees of freedom, resulting in undesirable play in the blade 2. The present disclosure provides a system that more adequately secures an open blade in all six degrees of freedom. FIGS. 33 through 39 illustrate a system, which may be referred to as the stop and wedge system, wherein the open blade of an OTF automatic knife is held more ridged in all six degrees of freedom.

Figure 33:
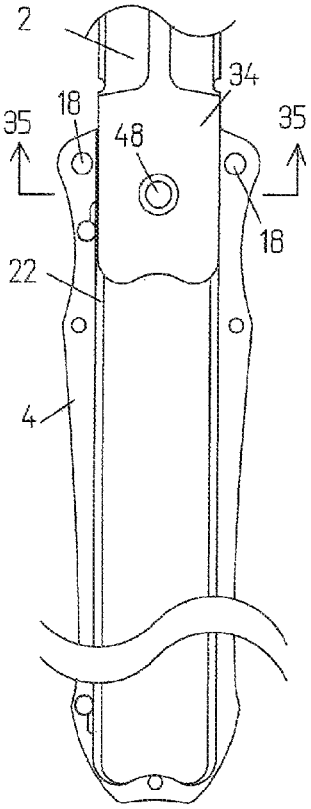
FIG. 33 is a bottom plan view of the blade and tang positioned within the center section.

FIG. 33 shows a bottom plan view of handle center section 4 with blade 2 and integral tang 34, in the locked open position. The locking mechanism of integral tang 34 discussed above has been omitted for the sake of clarity. Handle center section 4 includes a plurality of smooth bores 18 configured to accept threaded inserts.

Figure 35:
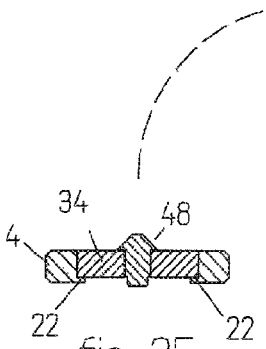
FIG. 35 is a cross section view as indicated in FIG. 33.
Figure 36:
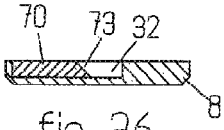
FIG. 36 is a cross section view as indicated in FIG. 34.
Figure 37:
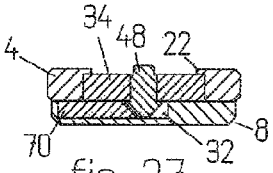
FIG. 37 is a combined cross section of FIGS. 35 and 36.
Figure 34:
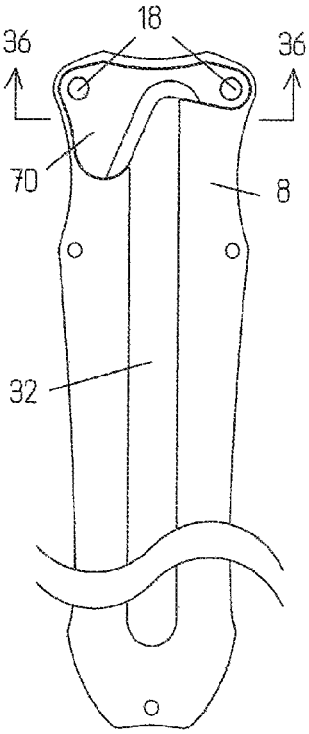
FIG. 34 is a top plan view of the bottom cover with a stop plate in place.
Figure 39:
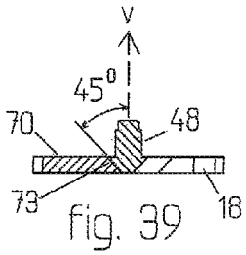
FIG. 39 is a cross section view as indicated in FIG. 38.
Figure 38:
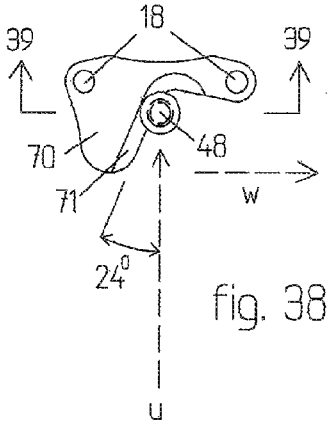
FIG. 38 is a top plan view of a stop plate.

FIG. 34 shows a top plan view of bottom handle cover 8 with stop plate 70 in place. FIG. 35 and FIG. 36 are cross sections of FIGS. 33 and 34 respectively. FIG. 35 shows the relative position of blade tang 34 with respect to blade guide rails 22. Stop pin 48 is shown protruding beyond the surface of blade tang 34, the free travel of which is accommodated for by the presence of stop pin clearance grove 32 of bottom handle cover 8, shown in FIGS. 36 and 34. When assembled, the cross section of handle center section 4 shown in FIG. 35 follows the path of arrow (t) to join the cross section of bottom handle cover 8 shown in FIG. 36, resulting in the conjoined cross section of handle center section 4 and bottom handle cover 8 shown in FIG. 37, illustrating the relative position of related components. FIG. 38 is a top plan view of stop plate 70 and its relationship to stop pin 48. FIG. 39 is a cross section view of FIG. 38 in elevation, further indicating the relationship of stop pin 48 and stop plate 70. Stop plate 70 has a first angled surface 71 shown in FIG. 38 and a second angled surface 73 shown in FIGS. 36 and 39.

When blade 2 and stop pin 48 travel forward to the lock open position (shown in FIG. 30), in the direction of arrow (u) shown in FIG. 38, stop pin 48 simultaneously contacts the first angled surface 71 of the stop plate 70, as shown in FIG. 38, and contacts the second angled surface 73 shown in FIG. 39. The contact of stop pin 48 with the two angled surfaces 71 and 73 of the stop plate 70 produces the duel effect of wedging blade 2 and integral tang 34 into a fixed position in two planes at once. As shown in FIG. 38 the first angled surface 71 may be substantially at 24 degrees and the second angled surface 73 may be substantially at 45 degrees, as shown in FIG. 39. As used herein, the term "substantially" means at least almost entirely. In quantitative terms, "substantially" means at least 80% of a stated reference. The stop pin 48 may include surfaces configured to mate with the first and second angled surfaces 71 and 73. The configuration of the mating surfaces of the stop pin 48 as well as the angles of the first and second angled surfaces may be varied from the configuration as shown in FIGS. 35-38 and still provide locking in two planes at once as would be appreciated by one of ordinary skill in the art having the benefit of this disclosure.

Figure 40:
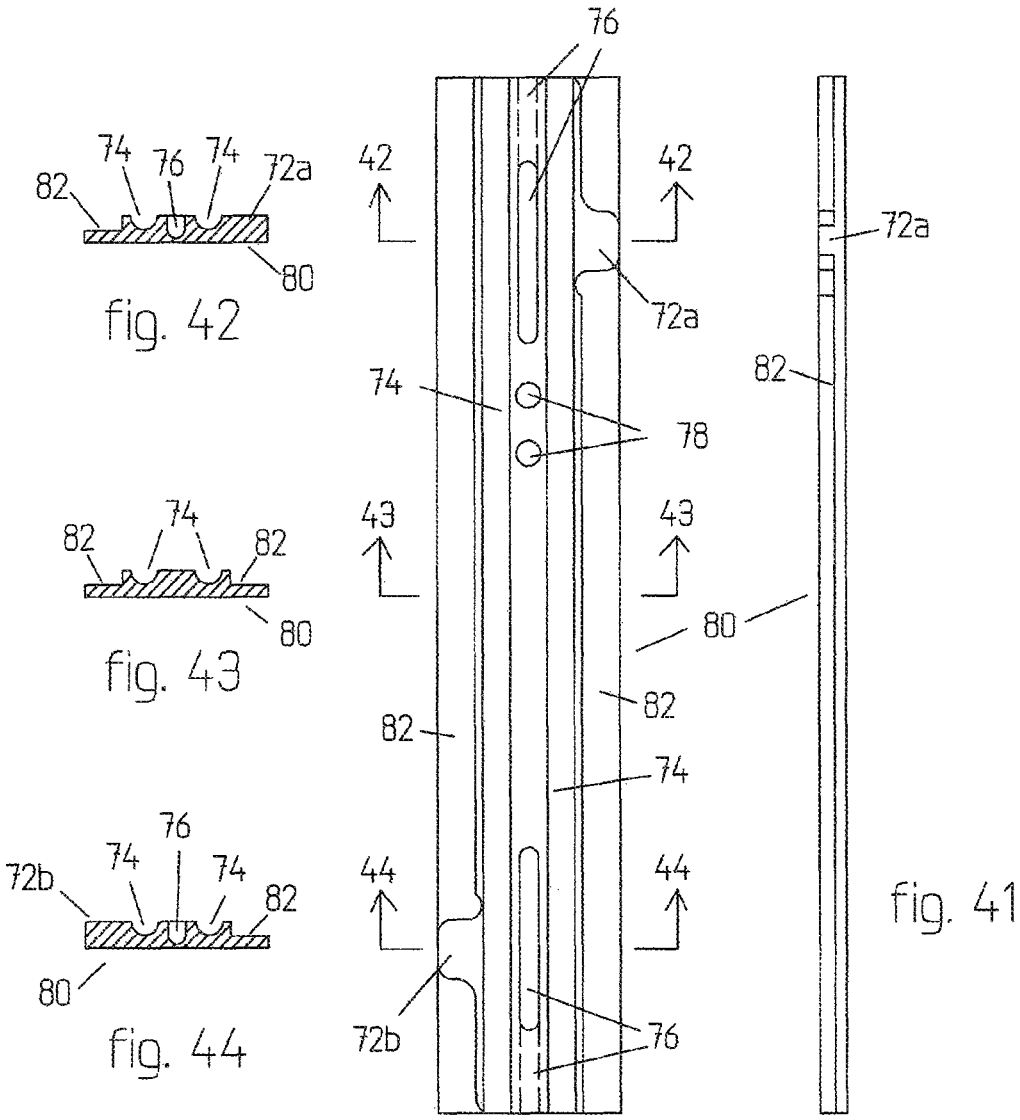
FIG. 40 is a bottom plan view of a shuttle plate.
Figures 61A, 61B:
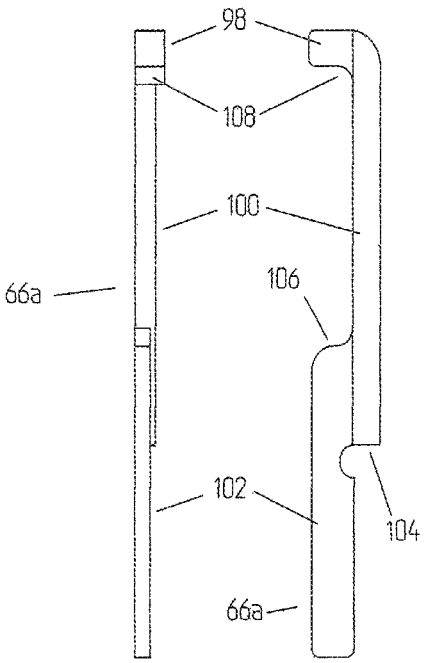
FIG. 61*a* shows a bottom plan view of a de-locking control hook.
FIG. 61*b* shows a left side, side view of the de-locking control hook of FIG. 61*a*.
Figure 60C:
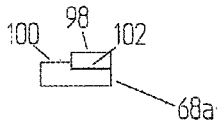
FIG. 60*c* shows an end view of the control hook of FIG. 60*a*.

FIGS. 40 through 44 illustrate the details of a shuttle plate 80. FIG. 40 shows a bottom plan view of the shuttle plate 80, indicating the location of two shuttle plate trip bosses 72*a*, and 72*b*, left standing for the purpose of actuating the de-locking control hooks 66*a* and 66*b* shown in FIGS. 29 through 32. Shuttle plate 80 is located within shuttle plate pocket 28 of handle frame top cover 6 (shown in FIGS. 9 and 11-14), which constrains the movement of shuttle plate 80 to a linear travel path. The linear movement of shuttle plate 80 activates de-locking control hooks 66*a* and 66*b* (best seen in FIGS. 62 and 63). When shuttle plate 80 is moved forward, in response to operator input, shuttle trip boss 72*b* contacts the de-locking shoulder 106 of de-locking control hook 66*b*, which will set in motion the de-locking cycle, thereby releasing blade 2 to be propelled to the open position. When shuttle plate 80 is made to move rearward, in response to operator input, shuttle trip boss 72*a* will come into contact with the de-locking shoulder 106 of de-locking control hook 66*a* (shown in FIG. 61*a*), setting in motion the de-locking cycle, releasing blade 2 to be propelled to the closed position. Also shown are the main spring pockets 74, guide pin channels 76, and sliding button mounting holes 78. Spring loaded control hooks 68*a* and 68*b*, and de-locking control hooks 66*a* and 66*b*, are supported by and guided by, control hook cavity 82 as provided by the configuration of shuttle plate 80. Main spring pockets 74 provide clearance for the location of main springs 94 (not shown in FIGS. 40-44). Guide pin channels 76 control the linear motion and alignment of a thrust block 84 and guide pin 88 combination (not shown in FIGS. 40-44). Sliding button mounting holes 78 provide a means for fastening a sliding button 10 (not shown in FIGS. 40-44) to be manipulated by an operator.

Figure 45A:
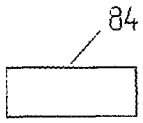
FIG. 45*a* shows a plan view of a thrust block.
Figure 48:
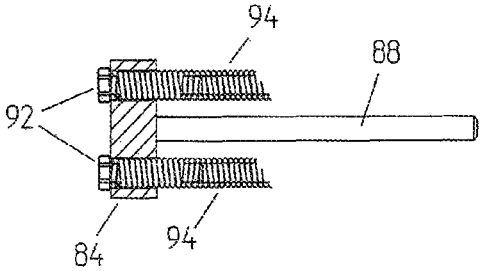
FIG. 48 is a cross sectional view of the sub-assembly of FIG. 47.
Figure 45C:
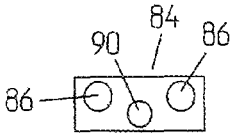
FIG. 45*c* shows an end view of a thrust block.
Figure 45B:
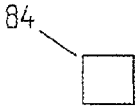
FIG. 45*b* shows a side view of a thrust block.
Figure 46:
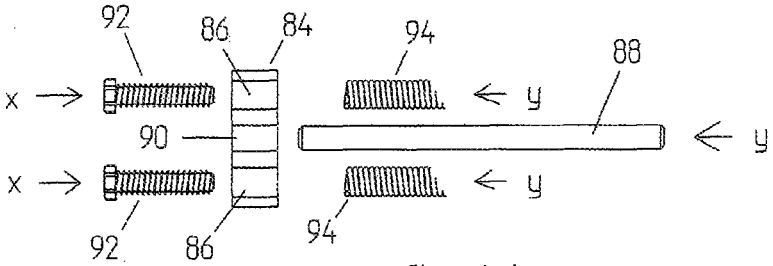
FIG. 46 is a plan view of the thrust block, spring anchor screws, main springs and guide pin before sub-assembly.
Figure 47A:
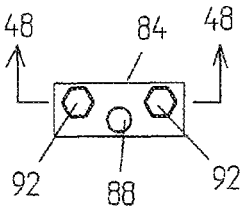
FIG. 47*a* is an end view of thrust block, spring anchor screws, main springs and guide pin after sub-assembly.
Figure 47B:
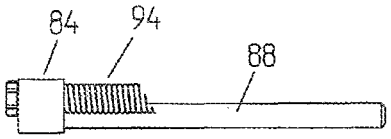
FIG. 47*b* is a side view of thrust block, spring anchor screws, main springs and guide pin after sub-assembly.

FIGS. 45*a* through 48 illustrate the details of thrust blocks 84 and a method of attachment to main springs 94 by the use of threaded spring anchors 92. FIGS. 45*a-c* show a top, side and end view of thrust block 84. FIG. 46 is a disassembled view showing thrust block 84, with hidden lines indicating the location of spring anchor holes 86, and hidden lines showing location of guide pin hole 90 in thrust block 84. As shown in FIGS. 46, 47*a* and 47*b*, threaded spring anchors 92, which contain threads of a thread count-per-inch corresponding to the coils per inch of the main springs 94, are threaded into main springs 94 through spring anchor holes 86 in the combined directions of arrows (x) to (y). Also shown in FIG. 46, guide pin 88 may be pressed into guide pin hole 90 of thrust block 84 in direction of arrow (y) in order to form a combined unit as shown in FIGS. 47*a*, 47*b*, and 48. The cross sectional view of FIG. 48 further illustrates the relationship between the components of the thrust block, main spring, sub-assembly.

FIGS. 49 through 52*b* show the assembly of shuttle plate 80 with thrust blocks 84 and main springs 94. FIG. 49 is a bottom plan view showing thrust blocks 84 and main springs 94 retained by guide pins 88 within guide pin channels 76 of shuttle plate 80 and subject to the preload tension of main springs 94. Main springs 94 are connected to threaded spring anchors 92 of opposing thrust blocks 84 positioned at ends of the shuttle plate 80. FIG. 50 shows a cross sectional view of shuttle plate 80 with main springs 94 positioned within main spring pockets 74 and guide pin 88 positioned within guide pin channel 76. FIG. 51 shows a long axis cross sectional view of the shuttle plate assembly.

FIG. 52*a* shows the shuttle plate 80 moved away from one of the thrust blocks 84 in preparation for actuating the blade 2 (not shown in FIG. 52*a*) from the open position to the closed position. The thrust block 84 is held in position away from shuttle plate 80 by its engagement with the drive pin 60 portion of the stop pin 48 (not shown in FIG. 52*a*), while the shuttle plate 80 has been manually moved away from thrust block 84 by means of sliding button 10 prior to firing. Sliding button mounting holes 78 are configured to connect sliding button 10 to shuttle plate 80. FIG. 52*b* shows an end view of the shuttle plate assembly and thrust block 84.

Figure 53A:
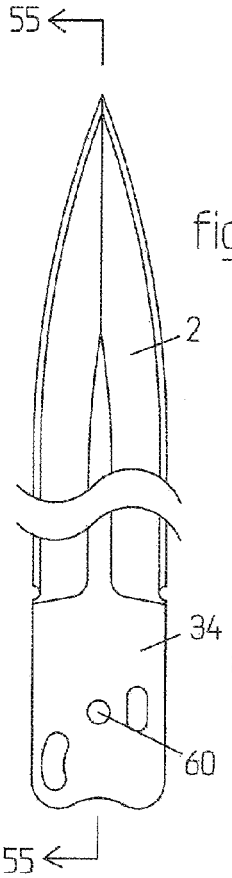
FIG. 53*a* is a partial top plan view of blade and tang.
Figure 53B:
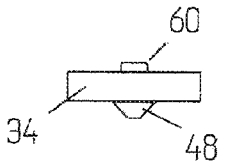
FIG. 53*b* is an end view of blade and tang.
Figure 54:
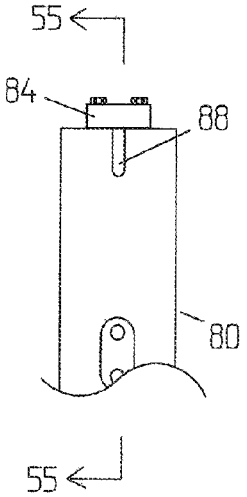
FIG. 54 is a partial top plan view of shuttle plate assembly.
Figure 55A:
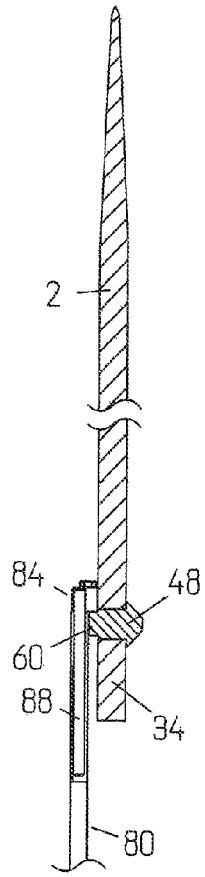
FIG. 55*a* is a cross sectional view of FIGS. 53 and 54 combined, with the blade in the locked open position.
Figure 55B:
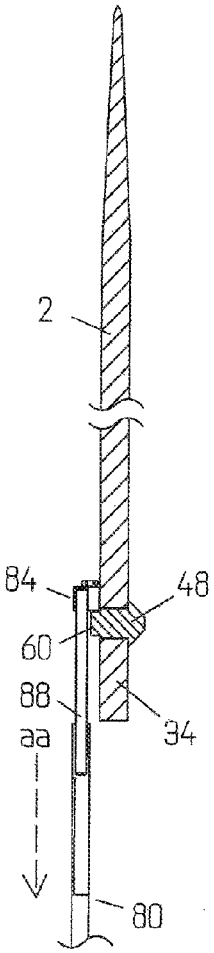
FIG. 55*b* is the same view of the same parts as FIG. 55*a* but with the shuttle plate loaded against spring tension preparatory to firing.

FIGS. 53*a* through 55*b* illustrate the relationship between blade 2, shuttle plate 80, and thrust block 84. FIGS. 53*a-b* are a top plan view and end view of blade 2 and integral tang 34. FIG. 54 is a partial top plan view of shuttle plate 80 and thrust block 84. FIG. 55*a* is a combined cross sectional view of the blade 2 with integral tang 34 and shuttle plate 80 with connected thrust block 84. The drive pin 60 portion of the stop pin 48 engages thrust block 84. By way of example, thrust block 84 may be positioned further from the center of shuttle plate 80 than drive pin 60 such that a lower shoulder of thrust block 84 contacts drive pin 60. FIG. 55*b* indicates the new relative position of the same components when shuttle plate 80 is moved in the direction of arrow (aa) preparatory to actuating the blade 2. As shown in FIG. 55*b*, thrust block 84 is positioned further from the center of shuttle plate 80 and thrust block guide pin 88 is partially extended from the end of shuttle plate 80. Further, the configuration of thrust block 84 and shuttle plate 80 corresponds to the configuration shown in FIG. 52*a*, in preparation for actuating the blade 2 from an open position to a closed position.

FIGS. 56 through 59 show a complete subassembly of top handle cover 6 with shuttle plate 80 and its related components installed and secured by the installation of sliding button 10. Sliding button 10 may capture the shuttle plate assembly and simultaneous allow it to move forward and rearward by manipulating sliding button 10, by virtue of the access provided by sliding button slot 12 and according to the linear limitations established by shuttle plate 80 within shuttle plate pocket 28.

Figures 60A, 60B:
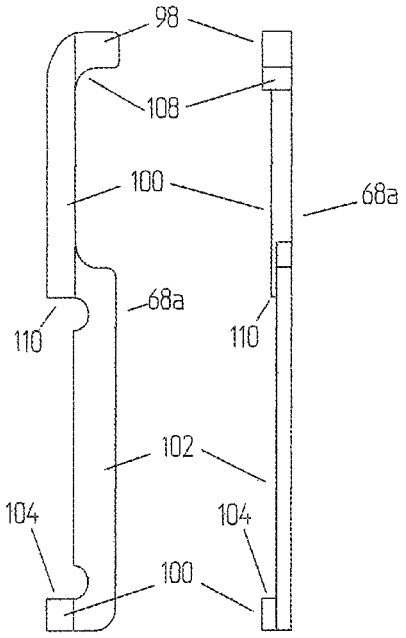
FIG. 60*a* shows a bottom plan view of control hook.
FIG. 60*b* shows a right side, side view of the control hook of FIG. 60*a*.
Figure 61C:
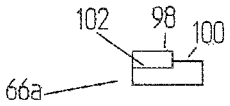
FIG. 61*c* shows an end view of the de-locking control hook of FIG. 61*c*.

FIGS. 60*a* through 61*c* show spring loaded control hook 68*a*, and de-locking control hook 66*a*, in bottom plan view and related side and end views, indicating the various surface features established for guidance, clearance and engagement. Control hook engagement level 98 is on a plane of engagement corresponding to that of control pin 56 of lock bar 50 (shown in FIG. 30) and control pin 57 of rocker bar 52 (also shown in FIG. 30). Control hook clearance level 102 is on a plane corresponding to the surface of shuttle plate 80 to maintain clearance for the travel of control pins 56 and 57. Control hook spring level 100 is on a plane corresponding to the control hook pocket 24 to guide control hooks and engage control hook springs 96 with control hook spring stops 104. The spring travel stop 110 of the spring loaded control hook 68*a* engages control hook spring stop 26 of handle frame top cover 6 to limit travel of spring loaded control hook 68*a*. FIG. 60*a* shows spring loaded control hook 68*a* in plan view. FIG. 60*b* shows a right side, side view of FIG. 60*a*, FIG. 60*c* shows an end view of FIG. 60*a*. FIG. 61*a* shows a plan view of de-locking hook 66*a*. FIG. 61*b* shows a left side, side view of FIG. 61*a*, and FIG. 61*c* shows an end view of FIG. 61*a*. As shown in FIG. 61*a*, a de-locking shoulder 106 of de-locking hook 66*a* is configured to engage shuttle trip boss 72*a* of shuttle plate 80 during the de-locking cycle. It should be noted that control hooks 68*b* and 66*b*, are parts identical to 68*a* and 66*a*, but positioned in reverse, and at the rear of the handle assembly, to perform similar functions at the opposite end of the cycle.

Figure 64:
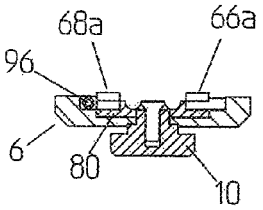
FIG. 64 is a cross sectional view of FIG. 63.
Figure 62:
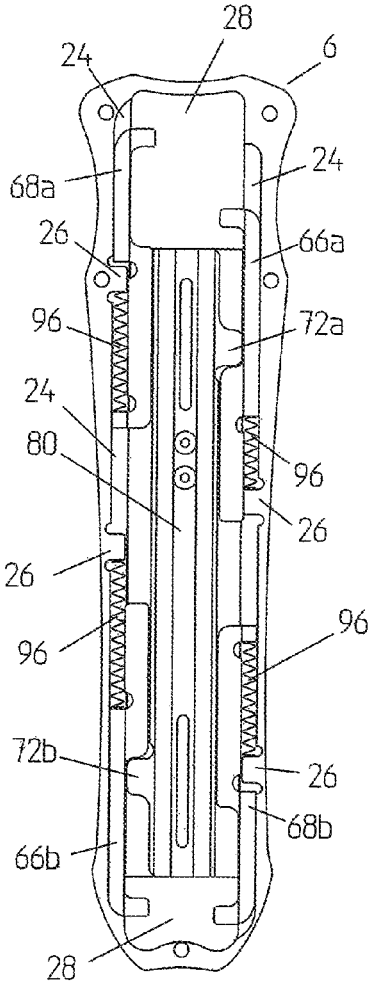
FIG. 62 shows a bottom plan view of the top cover with the shuttle plate and four control hooks installed, along with four control hook springs.
Figure 63:
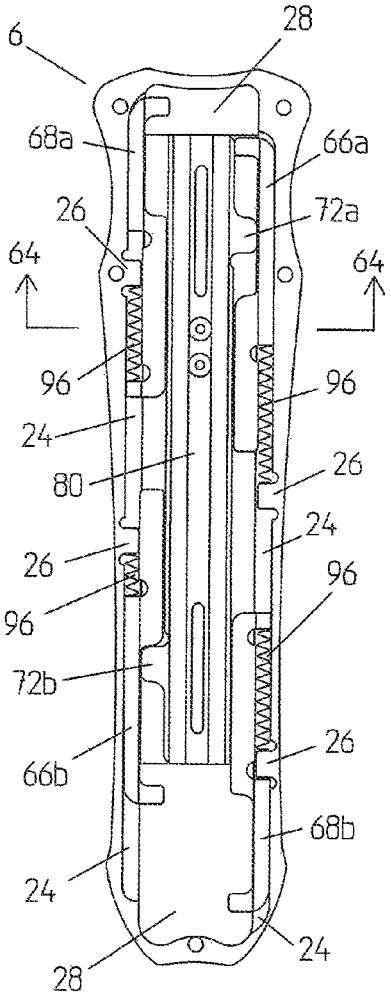
FIG. 63 shows the same view and same parts as FIG. 60 but with the shuttle plate at the opposite end of its travel.

FIGS. 62 through 64 show how spring hooks 66*a*, 66*b*, 68*a*, and 68*b* are relatively positioned, spring loaded, and manipulated by the forward and rearward movement of the shuttle plate 80. Some components of the shuttle plate assembly have been omitted for clarity. FIGS. 62 and 63 are bottom plan views of top handle cover 6 containing shuttle plate 80 with control hooks 66*a*, 66*b*, 68*a*, and 68*b* positioned in control hook pockets 24. Control hook springs 96 are positioned between control hook spring stops 26 and control hooks 66*a*, 66*b*, 68*a*, and 68*b*. Control hook springs 96 bias control hooks 68*a* and 66*b* in a downward position. Control hook springs 96 bias control hooks 68*b* and 66*a* in an upward position. FIG. 60 shows the shuttle plate assembly in its rearmost position with control hook springs 96 corresponding to control hooks 68*b* and 66*a* in a compressed configuration. FIG. 61 shows the shuttle plate assembly in its foremost position with control hook springs 96 corresponding to control hooks 68*a* and 66*b* in a compressed configuration. FIG. 62 shows a cross sectional view of the shuttle plate assembly in its foremost positioned.

FIGS. 65 through 68 shows how top handle cover 6 and its assembly interface with center section 4, and how control hooks 68*a* and 66*a* are positioned to manipulate control pins 56 and 57. FIG. 65 is a partial bottom plan view, of top handle cover 6 with shuttle plate 80, control hooks 68*a* and 66*a*, and control hook springs 96 installed. Some parts have been omitted for clarity. FIG. 66*a* is a cross section of top handle cover 6 and its assembly, as indicated in FIG. 65. FIG. 67 is a partial top plan view of handle center section 4 with blade 2 in the open locked position. FIG. 68 is a cross section of handle center section 4 as indicated in FIG. 67. FIG. 66*b* shows the relative position of top handle cover 6 and its assembly after having traveled along the path of arc ar, and prior to final fastening to center section 4. For the benefit of clarity, only the control hooks 66*a* and 68*a* are shown in the final assembly as indicated by dotted lines in FIG. 67. When shuttle plate 80 is moved in the direction of arrow (s) shown in FIG. 65, by operator input, shuttle plate trip boss 72*a* contacts de-locking shoulder 106 of control hook 66*a*, causing control hook 66*a* to move in the same direction against the force of control spring 96. Referencing now to FIG. 67, when control hook 66*a* travels in the direction of arrow (s), control hook pin pocket 108 of control hook 66*a* contacts control pin 57 of rocker bar 52, causing rocker bar 52 to rotate in a counter clockwise direction as indicated by arrow (r), which in turn will move lock bar 50 upward, thereby releasing blade 2 to be propelled toward the closed position.

In Operation

A user of the double action, out-the-front automatic knife 1 may initiate opening of the blade 2 by applying forward pressure on sliding button 10. As sliding button 10 is moved forward, the shuttle plate 80 and its sub-assembly of main springs 94 and forward thrust block 84 move in unison via the fixed connection between sliding button 10 and shuttle plate 80. By way of example, such fixed connection may be provided by standard fasteners utilizing sliding button mounting holes 78. Shuttle plate 80 is constrained to linear motion by virtue of its contact within the limits of shuttle plate pocket 28 of top handle frame cover 6. During the first approximately 90% of total travel of sliding button 10, blade 2 will remain fixed in the lock closed position (shown in FIG. 32), by virtue of a positive engagement between lock ball 36 and dowel pin 20*b*. Because of the positive engagement between rear thrust block 84 and the drive pin portion 60 of stop pin 48, main springs 94 will be extended under tension as shuttle plate 80 is moved forward, in preparation for the final release to occur at the end point of sliding button 10 travel within sliding button slot 12. During the last remaining 10% of total travel of sliding button 10 within sliding button slot 12, shuttle trip boss 72*b* of shuttle plate 80 engages de-locking control hook 66*b*, which in turn makes contact with control pin 56 of lock bar 50, causing the forward motion of lock bar 50 within lock bar pocket 46. As lock bar 50 moves forward lock ball 36 will be free to recede into lock ball relief cavity 55 of lock bar 50, thereby releasing blade 2 with respect to dowel pin 20*b* of handle frame center section 4, allowing blade 2 to "fly" forward toward the open and locked position (shown in FIG. 2), propelled by the stored energy in main springs 94, at which point thrust block 84 will re-contact shuttle plate 80, to re-assume a pre-load condition. The momentum of blade 2 and integral tang 34 will propel the blade forward along rails 22 and extend beyond the end of center section 4. The locking mechanism is carried with the tang 34. The control pin 56 of lock bar 50 contacts control hook 68*a*. The force of control hook spring 96 resists the travel of control pin 56 against control hook 68, thereby sliding lock bar 50 rearward within lock bar pocket 46. The rearward movement of lock bar 50 rotates rocker bar 52 about rocker bar pivot point 58 and causes control pin 57 to move within control pin slot 40. When the lock bar 50 is moved to its full rearward position, lock bar ramp 54 forces lock ball 36 to protrude at least partially from integral tang 34, resulting in a locked engagement with a dowel pin 20*a*. The user, then desiring to close the blade 2, will apply pressure to the sliding button 10 in a rearward direction which will reverse the above described order of events causing the blade 2 to automatically close and lock.

From the description provided above a number of advantages of the current disclosure becomes evident.

The tapered stop pin 48, in conjunction with a tapered stop plate 70, consisting of duel angles of engagement, will guarantee that the blade 2 will be wedged tightly against any possible movement in the two principle planes, responsible for rigidity. Movement side to side along the flat plane of the blade is controlled by the first angled surface 71 and movement up and down, perpendicular to the flat plane of the blade is controlled by the second angled surface 73 corresponding to the taper of the stop pin.

Because the blade locking mechanism depends upon the interface between a traveling ball and stationary dowel pins, lock failure can only occur in the highly unlikely event that either the ball or the dowel pin would collapse under excess loading, due to the forces of compression. A further advantage is available in the fact that both the hardened polished ball and the hardened polished dowel pin are easily available as a mass produced part, of standard dimensions and very high quality, from a wide array of suppliers. In contrast, known designs may rely on difficult to machine configurations that must be made to close tolerances, then hardened and ground at the interface.

Because the lock mechanism, into itself, is completely contained within the tang of the traveling blade, the lock mechanism is therefore occupying space that would otherwise remain underutilized. Known designs may provide for separate lock mechanisms. One for lock open and another one for lock closed. The resultant saving of space significantly contributes to a more favorable handle to blade ratio in terms of relative size.

Other than the lock mechanisms contained within the blade tang, all other internal moving parts may travel only in a linear path. A feature which serves two important advantages. First, the fact that the parts are subjected only to the forces of tension, but not, bending, means they can be made thinner than otherwise. Second, the linear path eliminates the necessity to provide a rocking or rotating part, with the necessary space to accommodate the same part, in two different positions. All of which further contributes to a more desirable handle to blade ratio.

Accordingly, it may be seen that the double action, out-the-front, automatic knife, of the present disclosure provides a remarkably secure and robust locking system that requires less internal handle space as well as less cost to produce. Also, the compound angle, wedge lock system ensures that the open and locked blade is held more ridged than known systems.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A knife comprising:

a handle having a first end and a second end;

a button connected to the handle, the button configured to axially slide along a surface of the handle;

a blade with an integral tang, the blade and tang configured to move between a closed position wherein the blade and tang are positioned within the handle and an open position wherein the blade extends from the first end of the handle;

a locking mechanism positioned within the tang;

a thrust mechanism;

wherein when the blade is in the closed position and selectively locked movement of the button towards the first end of the handle selectively releases the locking mechanism and the thrust mechanism moves the blade to the open position, the blade then being selectively locked in the open position by the locking mechanism; and wherein when the blade is in the open position and selectively locked by the locking mechanism movement of the button towards the second end of the handle selectively releases the locking mechanism and the thrust mechanism moves the blade to the closed position, the blade then being selectively locked by the locking mechanism.

2. The knife of claim 1, the locking mechanism further comprising:

a lock bar, the lock bar having a control pin and a cavity, the lock bar being configured to axially move within a cavity in the tang;

a rocker bar having a control pin, a portion of the rocker bar connected to the lock bar, the rocker bar configured to pivot about an axis within a cavity in the tang, wherein rotational movement of the rocker bar axially moves the lock bar; and a ball, wherein when the locking mechanism is unlocked the ball is positioned within the cavity of the lock bar and when the locking mechanism is locked the ball is positioned between the lock bar and a dowel pin connected to the handle.

3. The knife of claim 2, wherein the ball is not positioned within the cavity of the lock bar when the locking mechanism is locked.

4. The knife of claim 3, further comprising:

an upper locking control hook;

an upper unlocking control hook;

a lower locking control hook; and a lower unlocking control hook;

wherein movement of the button controls movement of the upper and lower unlocking control hooks;

wherein when the blade is in the locked open position movement of the upper unlocking control hook towards the second end of the handle engages the control pin on the rocker bar to pivot the rocker bar to move the lock bar towards the first end of the handle that permits the ball to move into the cavity on the lock bar to selectively release the blade from the locked open position;

wherein when the blade is in the locked closed position movement of the lower unlocking control hook towards the first end of the handle engages the control pin on the locking bar moving the locking bar towards the first end of the handle to permit the ball to move into the cavity on the lock bar to selectively release the blade from the locked closed position.

5. The knife of claim 4, the thrust mechanism comprising a shuttle plate connected to the button, the shuttle plate having:

a first end;

a second end;

a lower profile configured to engage the lower unlocking control hook, wherein when the blade is in the locked closed position movement of the shuttle plate engages and moves the lower unlocking control hook; and an upper profile configured to engage the upper unlocking control hook, wherein when the blade is in the locked open position movement of the shuttle plate engages and moves the upper unlocking control hook.

6. The knife of claim 5, the thrust mechanism further comprising:

an upper thrust block positioned at the first end of the shuttle plate;

a lower thrust block positioned at the second end of the shuttle plate; and a plurality of springs positioned between the upper thrust block and the lower thrust block, wherein movement of the shuttle plate when the blade is in the locked open position or locked closed position increases the distance between the upper thrust block and the lower thrust block.

7. The knife of claim 6, wherein the tang of the blade includes a drive pin, wherein when the blade is in the locked open position the drive pin engages the upper thrust block and, when the blade is in the locked closed position the drive pin engages the lower thrust block.

8. The knife of claim 4, further comprising:

a stop pin connected to the tang; and a stop plate positioned within the handle, the stop plate having a first angled surface and a second angled surface;

wherein the stop pin is configured to mate with both the first angled surface and the second angled surface;

wherein when the stop pin mates with both the first and second angled surfaces the blade is constrained from movement in two planes.

9. A knife comprising:

a handle;

a button on the surface of the handle, the button being movable between an open position and a closed position;

a thrust mechanism;

a blade having an integral tang connected to the thrust mechanism and the button, wherein when the button is moved from the closed position to the open position the thrust mechanism moves the blade from being positioned entirely within the handle to a position extending from an end of the handle and wherein when the button is moved from the open position to the closed position the thrust mechanism moves the blade from a position extending from the end of the handle to being positioned within the handle;

a stop pin connected to the tang; and a stop plate positioned within the handle, the stop plate having a first angled surface and a second angled surface;

wherein the stop pin is configured to mate with both the first angled surface and the second angled surface when the blade is in the position extending from the end of the handle;

wherein when the stop pin mates with both the first and second angled surfaces the blade is constrained from movement in two planes.

10. The knife of claim 9, wherein the first angled surface is substantially at 24 degrees with respect to a direction of travel of the stop pin and a horizontal axis of the blade and the second angled surface is substantially at 45 degrees with respect to an axis of the stop pin and the horizontal axis of the blade.

11. A knife comprising:

a handle;

a blade having a tang and configured to axially slide within the handle between an open position with at least a portion of the blade extending from the handle and a closed position with the blade within the handle;

a thrust mechanism configured to actuate the blade between the open position and the closed position;

a locking mechanism within the tang of the blade having a lock position and an unlock position, the lock position restricting movement of the blade with respect to the handle and the unlock position permitting movement of the blade with respect to the handle, wherein the same locking mechanism is configured to selectively lock the blade in the open position and closed position; and a switch having a first position and a second position, wherein movement of the switch from the first position to the second position selectively actuates the locking mechanism from the lock position to the unlock position and the thrust mechanism moves the blade from the closed position to the open position, and movement of the switch from the second position to the first position selectively actuates the locking mechanism from the lock position to the unlock position and the thrust mechanism moves the blade from the open position to the closed position.

12. The knife of claim 11, wherein the movement of the blade between the open position and the closed position actuates the locking mechanism from the unlock position to the lock position.

13. The knife of claim 12, further comprising:

a stop pin connected to the tang; and a stop plate positioned within the handle, the stop plate having a plurality of angled surfaces;

wherein the stop pin engages the plurality of angled surfaces when the blade is in the open position;

wherein the engagement of the stop pin with the plurality of angled surfaces restricts movement of the blade in at least two planes.

14. The knife of claim 11, the locking mechanism further comprising a ball positioned in a ball pocket of the tang of the blade, the ball extending beyond a surface of the tang and contacting a portion of the handle to restrict movement of the blade with respect to the handle when the locking mechanism is in the lock position.

15. The knife of claim 14, the locking mechanism further comprising a lock bar configured to axially move along the tang, the lock bar having a recess configured to receive the ball when the locking mechanism is in the unlock position and having a ramp adjacent the recess, the ramp shaped to guide the ball from the recess to the ball pocket with axial movement of the tang.

16. The knife of claim 15, the locking mechanism further comprising a rocker bar pivotally connected to the tang of the blade, the rocker bar configured to engage the lock bar and convert rotational motion of the rocker bar into axial motion of the lock bar.

17. The knife of claim 16, further comprising:

an upper locking control hook, positioned to engage a portion of the lock bar when the blade slides from the closed position to the open position;

an upper unlocking control hook, wherein when the blade is in the open position movement of the upper unlocking control hook engages a portion of the rocker bar;

a lower locking control hook, positioned to engage a portion of the rocker bar when the blade slides from the open position to the closed position; and a lower unlocking control hook, wherein when the blade is in the closed position movement of the lower unlocking control hook engages a portion of the lock bar;

the switch controlling movement of the upper unlocking control hook and the lower unlocking control hook.

18. The knife of claim 17, the thrust mechanism comprising a shuttle plate connected to the switch, the shuttle plate having:

a first end;

a second end;

a lower profile configured to engage the lower unlocking control hook; and an upper profile configured to engage the upper unlocking control hook.

19. The knife of claim 18, the thrust mechanism further comprising:

an upper thrust block positioned at the first end of the shuttle plate;

a lower thrust block positioned at the second end of the shuttle plate; and at least one spring positioned between the upper thrust block and the lower thrust block, wherein movement of the shuttle plate when the blade is in the open or closed position increases the distance between the upper thrust block and the lower thrust block.

20. The knife of claim 19, wherein the tang of the blade includes a drive pin configured to selectively engage the upper thrust block and lower thrust block.

* * * * *